US010381204B2

(12) United States Patent
Tanaka

(10) Patent No.: US 10,381,204 B2
(45) Date of Patent: Aug. 13, 2019

(54) LAMINATED ULTRA-HIGH VACUUM FORMING DEVICE

(71) Applicant: NATIONAL INSTITUTE OF INFORMATION AND COMMUNICATIONS TECHNOLOGY, Tokyo (JP)

(72) Inventor: Shukichi Tanaka, Tokyo (JP)

(73) Assignee: NATIONAL INSTITUTE OF INFORMATION AND COMMUNICATIONS TECHNOLOGY, Tokyo (JP)

( * ) Notice: Subject to any disclaimer, the term of this patent is extended or adjusted under 35 U.S.C. 154(b) by 161 days.

(21) Appl. No.: 15/322,735

(22) PCT Filed: Apr. 21, 2015

(86) PCT No.: PCT/JP2015/062082
§ 371 (c)(1),
(2) Date: Dec. 29, 2016

(87) PCT Pub. No.: WO2016/002320
PCT Pub. Date: Jan. 7, 2016

(65) Prior Publication Data

US 2017/0133210 A1 May 11, 2017

(30) Foreign Application Priority Data

Jun. 30, 2014 (JP) ..... 2014-134301

(51) Int. Cl.
*H01J 41/12* (2006.01)
*F04B 37/14* (2006.01)
(Continued)

(52) U.S. Cl.
CPC ..... *H01J 41/12* (2013.01); *F04B 37/14* (2013.01); *H01J 41/18* (2013.01); *H01J 41/20* (2013.01)

(58) Field of Classification Search
CPC ..... F04B 37/06; F04B 37/14; F04B 19/006; H01J 41/12; H01J 41/20
See application file for complete search history.

(56) References Cited

U.S. PATENT DOCUMENTS 3,236,442 A * 2/1966 Davis ..... H01J 41/20 417/49
3,309,010 A * 3/1967 Hetherington ..... H01J 41/12 313/549
(Continued)

FOREIGN PATENT DOCUMENTS

DE 4110588 A1 10/1992
EP 0257394 A1 3/1988
(Continued)

OTHER PUBLICATIONS

Jeol, PS61168549UFORPAT_MachTrans, Oct. 1986, Translation Pages and FIG 1-2.*
(Continued)

*Primary Examiner* — Kenneth J Hansen
(74) *Attorney, Agent, or Firm* — Pyprus Pte Ltd

(57) ABSTRACT

Provided is an ultra-high vacuum forming device containing an ion pump having a compact size in the central axis direction. The ultra-high vacuum forming device (1) is provided with at least one ion pump (100). The ion pump (100) is provided with: a casing (110) having at least one opening (111, 112); a board-shaped electrode group (120) formed by means of a central opening (120*a*) being formed along a predetermined central axis (C) disposed within the casing (110), and a plurality of electrodes (121) being joined with spaces therebetween; a pair of board-shaped electrodes
(Continued)

(131, 132) having a different polarity than that of the electrode group (120) and that are disposed at positions sandwiching both sides of the electrode group (120) within the casing (110); and a pair of board-shaped magnets (141, 142) disposed at positions sandwiching both sides of the pair of board-shaped electrodes (131, 132).

5 Claims, 21 Drawing Sheets

(51) Int. Cl.
*H01J 41/18* (2006.01)
*H01J 41/20* (2006.01)

(56) References Cited

U.S. PATENT DOCUMENTS

| | | | | |
|---|---|---|---|---|
| 2006/0231773 | A1 | 10/2006 | Katagiri et al. | |
| 2012/0014814 | A1* | 1/2012 | Bonucci ..... | F04B 37/02 417/49 |

FOREIGN PATENT DOCUMENTS

| | | | |
|---|---|---|---|
| JP | 52-53513 | A | 4/1977 |
| JP | 168549/1986 | | 10/1986 |
| JP | 7-59943 | B2 | 6/1995 |
| JP | 4831549 | B2 | 9/2011 |
| JP | 4835756 | B2 | 10/2011 |

OTHER PUBLICATIONS

Extended European Search Report of EP application No. 15814570.6 dated Jan. 19, 2018 (8 pages).

A Roth et al: "5.7 Gettering" In: "Vacuum Technology", Mar. 21, 1990, Elsevier Science ProQuest Ebook Central, XP055438996, ISBN: 978-0-444-59874-5 pp. 263-270, Section 5.7.5; p. 270.

International Search Report of International Application No. PCT/JP2015/062082 completed May 22, 2015 and dated Jun. 2, 2015 (3 pages).

* cited by examiner

LAMINATED ULTRA-HIGH VACUUM FORMING DEVICE

TECHNICAL FIELD

The present invention relates to an ultra-high vacuum creating device. To be specific, the ultra-high vacuum creating device of the present invention includes at least one ion pump. In addition, the ultra-high vacuum creating device of the present invention is configured to include another ion pump, a heating and non-evaporating getter pump and a sublimation pump arbitrarily stacked on the ion pump according to an application, and accordingly, an exhaust characteristic thereof can be optimized according to the application.

BACKGROUND ART

Recently, an ultra-high vacuum technique has been regarded as important along with remarkable development of a nanotechnology and an ultra-precision measurement technique. For example, a surface of a semiconductor is easily contaminated by gas molecules, and conventionally, there has been a need of maintaining the semiconductor in an ultra-high vacuum state under $10^{-5}$ Pa or lower to keep the clean semiconductor surface. In addition, a field emission type charged particle source is used in a charged particle beam device, for example, which uses a finely focused electron beam or an ion source such as a scanning electron microscope in order to improve resolution. At this time, it is necessary to maintain an internal space of the charged particle source in the ultra-high vacuum state in order to stably operate this field emission type charged particle source. Thus, conventionally, an ultra-high vacuum pump such as an ion pump has been used as a device configured for the formation of the ultra-high vacuum state.

In this manner, the ultra-high vacuum environment under $10^{-5}$ Pa or lower, particularly, a class of $10^{-9}$ Pa to $10^{-7}$ Pa provides ultimate cleanness and stability, and thus, is indispensable for nanoscale ultra-precision machining, ultra-precision measurement, and the like. Conventionally, however, it has been considered that an exhaust device such as a bulky ion pump and a cryopump is necessary for creation and maintenance of such ultra-high vacuum environment. In this manner, the exhaust device has a large-scale structure, a chamber housing the device becomes bulky, and as a result, there is a problem that the entire device scale becomes unnecessarily larger and heavier.

Thus, a light, small and highly efficient ion pump having uniaxially symmetric electrode arrangement has been developed (Patent Literature 1) in order to solve the above-described problem and a cylindrical ion pump with a larger exhaust amount has been developed (Patent Literature 2) as an evolved type thereof. In particular, the ion pump described in Patent Literature 2 is the cylindrical ion pump in which a space with little electromagnetic field modulation, configured to store a sample and a charged particle source, is secured at the center thereof, and a pump element (a permanent magnet or the like) is arranged in the form of being stuck to a casing surface of an ultra-high vacuum chamber. Thus, it is revolutionary in terms that it is possible to realize high exhaust performance and space efficiency at the same time.

CITATION LIST

Patent Literature

Patent Literature 1: Japanese Patent No. 4831549
Patent Literature 2: Japanese Patent No. 4835756

SUMMARY OF INVENTION

Technical Problem

Meanwhile, the overall shape of the cylindrical ion pump disclosed in Patent Literature 2 is formed in a shape which is long in the central-axis direction and short in the direction orthogonal to the central axis (for example, a shape like a clay pipe) in order to secure the high exhaust performance. However, there is a case where it is difficult to sufficiently secure a space for mounting of the ion pump which is long in the central-axis direction depending on a shape of the vacuum chamber as a mounting target, and there is a problem that it is difficult to mount the ion pump to a desired vacuum chamber in such a case. In particular, an electron microscope is configured by scrupulously calculating each relative arrangement of parts forming an electron gun, and thus, in the current status, a space for mounting an ion pump is hardly provided in the central-axis direction of the ion pump in the case of mounting the conventional cylindrical ion pump in a lens barrel of the electron microscope or the like.

Thus, currently, there is a demand for an ultra-high vacuum creating device which includes an ion pump whose size in the central-axis direction is further reduced while maintaining basic performances of the conventional cylindrical ion pump such as light weight, efficiency, and an exhaust property.

Solution to Problem

Thus, the inventor of the present invention has dedicatedly studied solutions to the conventional problem, and as a result, has invented a configuration in which a plate-shaped electrode group, which has a center opening and is formed by connecting a plurality of electrodes at intervals, and a pair of plate-shaped electrode and a pair of plate-shaped magnet, provided on both upper and lower sides of the electrode group, are arranged inside a casing of an ion pump. According to such a configuration, it has been found out that it is possible to realize the thin ion pump whose size in the central-axis direction is further reduced while maintaining a basic performance such as an exhaust property. Further, the present inventor has conceived that it is possible to solve the problems of the related art based on the above-described finding, and completed the present invention. To be specific, the present invention has the following configurations.

The present invention relates to an ultra-high vacuum creating device.

The ultra-high vacuum creating device of the present invention includes at least one ion pump 100.

Here, the ion pump 100 includes a casing 110, a plate-shaped electrode group 120, a pair of plate-shaped electrodes 131 and 132, and a pair of plate-shaped magnets 141 and 142.

The casing 110 includes at least one of openings 111 and 112. The plate-shaped electrode group 120 and the pair of plate-shaped electrodes 131 and 132 are at least housed inside the casing 110 such that opposite poles thereof directly oppose therebetween.

The plate-shaped electrode group 120 is arranged inside the casing 110. The electrode group 120 has a predetermined central axis (C), and a center opening 120*a* is formed along the central axis (C). In addition, the electrode group 120 has a structure in which electrodes 121 are connected at intervals. In addition, the electrode group 120 may have a structure in which a hollow electrode 123 having a space inside thereof is provided and the electrode 121 is housed inside the hollow electrode 123.

The pair of plate-shaped electrodes 131 and 132 is arranged at positions inside the casing 110 such that the electrode group 120 is sandwiched therebetween. That is, the pair of plate-shaped electrodes 131 and 132 is arranged at both sides of the electrode group 120 in the central-axis direction.

The pair of plate-shaped magnets 141 and 142 is arranged at positions such that the pair of plate-shaped electrodes 131 and 132 is sandwiched therebetween. That is, the pair of plate-shaped magnets 141 and 142 is arranged at both sides of the pair of plate-shaped electrodes 131 and 132 sandwiching the electrode group 120 in the central-axis direction. The pair of plate-shaped magnets 141 and 142 may be arranged inside the casing 110, but is preferably arranged outside the casing 110. The pair of plate-shaped magnets 141 and 142 applies a magnetic field in the vertical direction inside the casing 110, and preferably in a space between the pair of plate-shaped electrodes 131 and 132.

As the above-described configuration, the plate-shaped electrode group 120 keeping the space is arranged, and the pair of thin plate-shaped electrodes and the pair of thin plate-shaped magnets are arranged at both sides of the electrode group 120 in the central-axis direction (up-and-down direction). Accordingly, it is possible to reduce the size of the ion pump 100 in the central-axis direction while maintaining the basic performance such as the exhaust property. That is, it is possible to effectively use the internal space of the casing 110 as a gas collecting space by providing the plate-shaped electrode group 120 keeping the space to be sandwiched by the pair of plate-shaped electrodes 131 and 132, and the pair of plate-shaped magnets 141 and 142 from both the upper and lower sides. Further, the ion pump 100 maintains the exhaust performance or the likes by widening a horizontal width of the plate-shaped electrode group 120, and further, includes the thin plate-shaped electrodes 131 and 132, and the plate-shaped magnets 141 and 142 arranged at both the upper and lower sides of the electrode group 120. Thus, it is possible to reduce the length (that is, thickness) of the ion pump 100 in the central-axis direction while maintaining the exhaust performance of the ion pump 100. For example, it is possible to set the length of the ion pump 100 in the central-axis direction to be about ¼ of a length of the conventional ion pump according to the configuration of the present invention. Therefore, it is possible to mount the high-performance ion pump 100 (ultra-high vacuum creating device) without changing the basic shape or arrangement thereof even in the case of the electron microscope which has a limit regarding a mounting space, for example.

In the ultra-high vacuum creating device of the present invention, at least one of the openings 111 and 112 is preferably formed on the central axis (C) in the casing 110 of the ion pump 100.

In addition, center openings 133 and 134 are preferably formed on the central axis (C) in the pair of plate-shaped electrodes 131 and 132, respectively.

Further, center openings 143 and 144 are preferably formed on the central axis (C) in the pair of plate-shaped magnets 141 and 142, respectively.

Accordingly, a gas flow path or a space configured to house experimental equipment or cause the experimental equipment to pass therethrough is formed along the central axis (C) in the ultra-high vacuum creating device of the present invention.

As the above-described configuration, it is possible to secure the space to house the experimental equipment or cause the experimental equipment to pass therethrough by forming the columnar space along the central axis (C) of the electrode group 120. In addition, it is possible to secure a wide discharge space by, for example, forming the electrode group 120 using the plurality of ring-shaped electrodes 121 to share each central axis of the pair of plate-shaped electrodes 131 and 132 and the pair of plate-shaped magnets 141 and 142.

Further, it is possible to stack a plurality of the ion pumps 100, configured as described above by causing the openings 111 and 112 to communicate with each other. When the plurality of ion pumps 100 are stacked, the performance and service life thereof can be improved. Therefore, it is possible to mount the ultra-high vacuum creating device having the optimal configuration in terms of the device scale and the performance by adjusting the number of the ion pumps 100 to be stacked in accordance with tolerance of the mounting space. In this manner, the ultra-high vacuum creating device of the present invention has multi-stage extensibility in the central-axis direction. That is, the ultra-high vacuum creating device according to the present invention is capable of stacking the plurality of ion pumps 100 in any stages as long as the space allows it.

In the ultra-high vacuum creating device of the present invention, two or more of the ion pump 100 may be stacked along the central-axis (C) direction. In this case, it is preferable that the neighboring ion pumps 100 share one of the pair of plate-shaped magnets 141 and 142. That is, the shared plate-shaped magnet functions so as to apply the magnetic field to both the two neighboring ion pumps 100.

As the above-described configuration, it is possible to further reduce the size in the central-axis direction by causing one of the plate-shaped magnets 141 and 142 to be shared in the case of stacking the ion pumps 100, and further, it is possible to reduce the gross weight of the device as compared to the case of simply connecting the ion pumps 100 in series since it is possible to omit one plate-shaped magnet, which is a heavy object, or more.

The ultra-high vacuum creating device of the present invention may include at least one heating and non-evaporating getter pump 200 in addition to one or plurality of ion pumps 100.

The heating and non-evaporating getter pump 200 includes a casing 210, a heater 220, and a pair of getter materials 231 and 232.

The casing 210 includes at least one of openings 211 and 212. The heater 220, and the pair of getter materials 231 and 232 are arranged inside the casing 210.

The heater 220 heats the pair of getter materials 231 and 232. The heater 220 preferably has a plate shape.

The pair of getter materials 231 and 232 is arranged at positions inside the casing 210 such that the heater 220 is sandwiched therebetween from both the upper and lower sides. The getter materials 231 and 232 are heated in vacuum by a radiant heat from the heater 220 and activated by discharging a gas that has been stored therein, thereby functioning as a pump.

Further, at least one of openings 211 and 212 of the heating and non-evaporating getter pump 200 communicates with at least one of openings 111 and 112 of the ion pump 100 in the ultra-high vacuum creating device of the present invention.

As the above-described configuration, the ultra-high vacuum creating device of the present invention can be constructed by combining the ion pump 100 and the heating and non-evaporating getter pump 200.

In the ultra-high vacuum creating device of the present invention, at least one of the openings 211 and 212 is preferably formed on the central axis (C) in the casing 210 of the heating and non-evaporating getter pump 200.

In addition, a center opening 221 is preferably formed on the central axis (C) in the heater 220.

Further, center openings 233 and 234 are preferably formed on the central axis (C) in the pair of getter materials 231 and 232, respectively.

Accordingly, a gas flow path and a space configured to house experimental equipment or cause the experimental equipment to pass therethrough is formed along the central axis (C) in the ultra-high vacuum creating device which is configured to include the ion pump 100 and the heating and non-evaporating getter pump 200.

As the above-described configuration, it is possible to secure the space configured to house the experimental equipment or cause the experimental equipment to pass therethrough by forming the columnar space along the central axis (C) at the time of combining the ion pump 100 and the heating and non-evaporating getter pump 200. Thus, it is possible to efficiently use the ion pump 100 and the heating and non-evaporating getter pump 200 in combination according to the ultra-high vacuum creating device of the present invention.

The ultra-high vacuum creating device of the present invention may include a sublimation pump 300 in addition to one or plurality of ion pumps 100.

The sublimation pump 300 includes a casing 310, a sublimation filament 320, and a shield 330.

The casing 310 includes at least one of openings 311 and 312. The sublimation filament 320 is arranged inside the casing 310.

The sublimation filament 320 is a ring-shaped filament member which is sublimated when current flows.

Further, at least one of openings 311 and 312 of the sublimation pump 300 communicates with at least one of openings 111 and 112 of the ion pump 100 in the ultra-high vacuum creating device of the present invention.

As the above-described configuration, the ultra-high vacuum creating device of the present invention can be constructed by combining the ion pump 100 and the sublimation pump 300.

In the ultra-high vacuum creating device of the present invention, at least one of openings 311 and 312 is preferably formed on the central axis (C) in the casing 310 of the sublimation pump 300. Accordingly, a gas flow path or a space configured to house experimental equipment or cause the experimental equipment to pass therethrough is formed along the central axis (C) in the ultra-high vacuum creating device which is configured to include the ion pump 100 and the sublimation pump 300.

As the above-described configuration, it is possible to secure the space configured to house the experimental equipment or cause the experimental equipment to pass therethrough by forming the columnar space along the central axis (C) at the time of combining the ion pump 100 and the sublimation pump 300. Thus, various characteristics of the ion pump 100 and the sublimation pump 300 are effectively combined according to the ultra-high vacuum creating device of the present invention, and thus, can be used as an efficient pump system.

Advantageous Effects of Invention

According to the present invention, it is possible to provide the ultra-high vacuum creating device which includes the ion pump whose size in the central-axis direction is further reduced while maintaining the basic performances of the conventional ion pump such as the light weight, the efficiency, and the exhaust property.

The ion pump 100 has a thin shape (preferably, a disc shape) in the present invention, and accordingly, can also be mounted in, for example, a vacuum chamber with few margin in the mounting space such as the lens barrel of the electron gun. In addition, it is also possible to mount the heating and non-evaporating getter pump 200 having an excellent gettering performance of hydrogen in an ultra-high vacuum space and the sublimation pump 300 having an excellent gettering performance in a low vacuum space as well as the ion pump 100 combinedly in the vacuum chamber with a margin in the mounting space. When a plurality of pump units are connected in tandem with each other in this manner, the exhaust amount and exhaust characteristics thereof can be enhanced and adjusted if necessary. Accordingly, the ultra-high vacuum creating device of the present invention has, for example, a start-up vacuum level of $10^{-4}$ Pa to $10^{-3}$ Pa and can improve an ultimate vacuum level up to $10^{-9}$ Pa to $10^{-8}$ Pa.

The ultra-high vacuum creating device of the present invention can be suitably applied to, for example, an ion beam processing device in which large gases are released from a sample, various processing devices, an ionized gas generation device, an ion source generation device, and the like. In addition, the ultra-high vacuum creating device of the present invention can also be suitably applied to, for example, a synchrotron radiation facility which requires more stable ultra-high vacuum environment, an ion trap, an atomic clock, and the like.

DESCRIPTION OF EMBODIMENTS

Hereinafter, embodiments of the present invention will be described with reference to the drawings. The present invention is not limited to the embodiments described below, but includes amendments thereto made appropriately by those skilled in the art to the extent obvious.

In the specification of the present application, a "plate shape" means a shape formed to have the width longer than the thickness. The plate shapes include not only a disk shape but also a polygonal plate shape such as a square plate shape.

In the specification of the present application, a "ring shape" means a shape formed to have an opening at the center thereof. The ring shapes include not only a circular ring shape but also a polygonal ring shape such as a square ring shape.

[1. Ion Pump]

An ultra-high vacuum creating device 1 according to the present invention is configured to include an ion pump 100. FIGS. 1 to 9 illustrate configuration examples of the ion pump 100 included in the present invention.

An operation principle of an ion pump is well-known. The operation principle of the ion pump will be briefly described. First, a voltage of several kV is applied between a titanium negative electrode (cathode) and a positive electrode (anode) of the ion pump, primary electrons are released from the titanium negative electrode. The primary electrons released from the titanium negative electrode are affected by a magnetic field applied from a magnet while being attracted to the positive electrode, and thus, the primary electrons reach the positive electrode by whirling round in a long spiral motion. On the way to the positive electrode, the primary electrons collide against neutral gas molecules to generate many positive ions and secondary electrons. The positive ions are accelerated toward the titanium negative electrode by a high voltage, thereby sputtering titanium atoms. The sputtered titanium atoms adhere to the positive electrode or the like to adsorb the gas molecules (getter effect). Incidentally, the secondary electrons further perform a spiral motion and collide against the gas molecules to generate more positive ions and electrons (tertiary electrons). Accordingly, the gas molecules inside a certain space are collected in the ion pump, and the space can be set to the ultra-high vacuum state of $10^{-5}$ Pa or lower.

Figure 1:
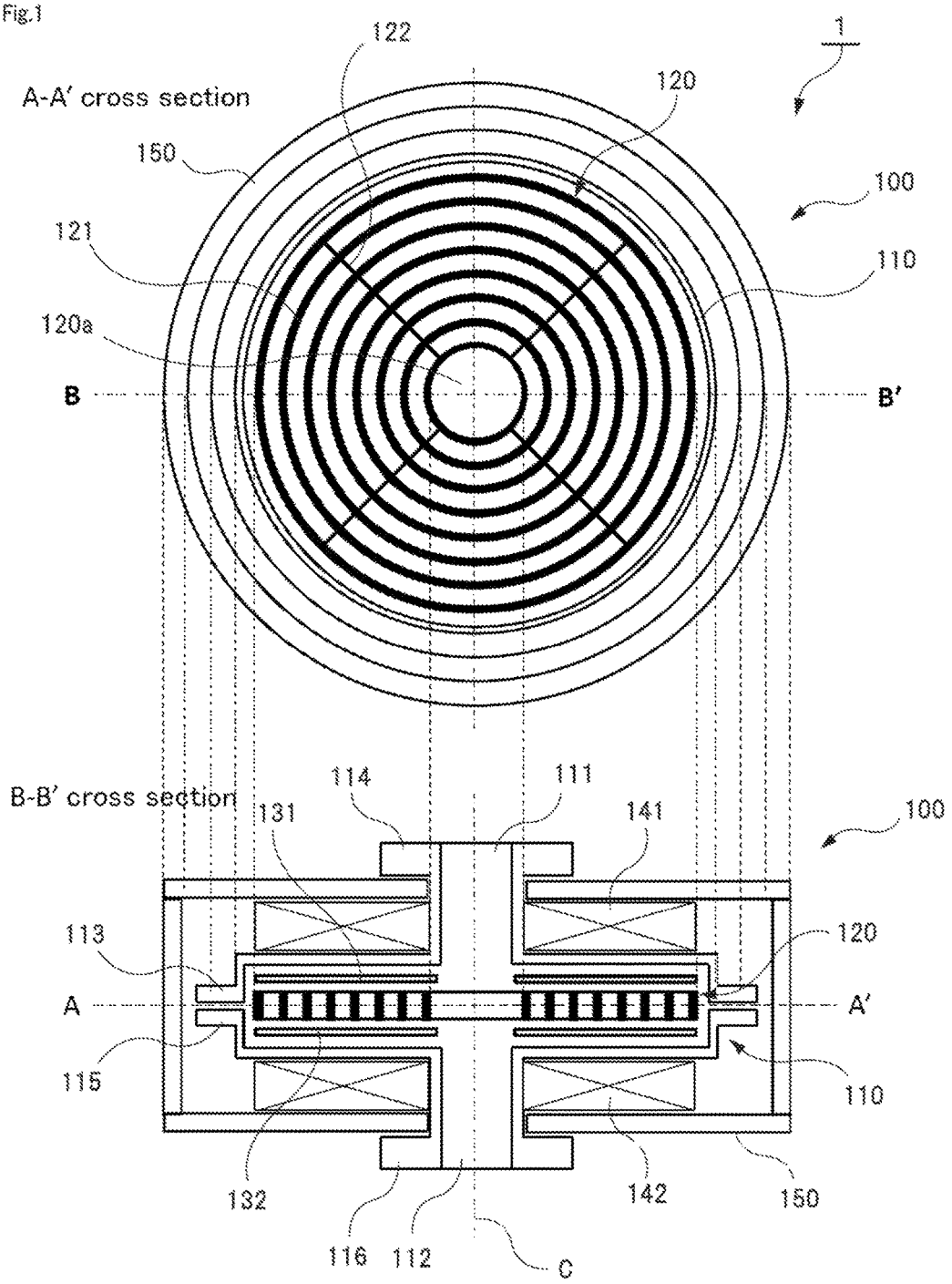
FIG. 1 is a cross-sectional view illustrating a configuration example of an ion pump.
Figure 2:
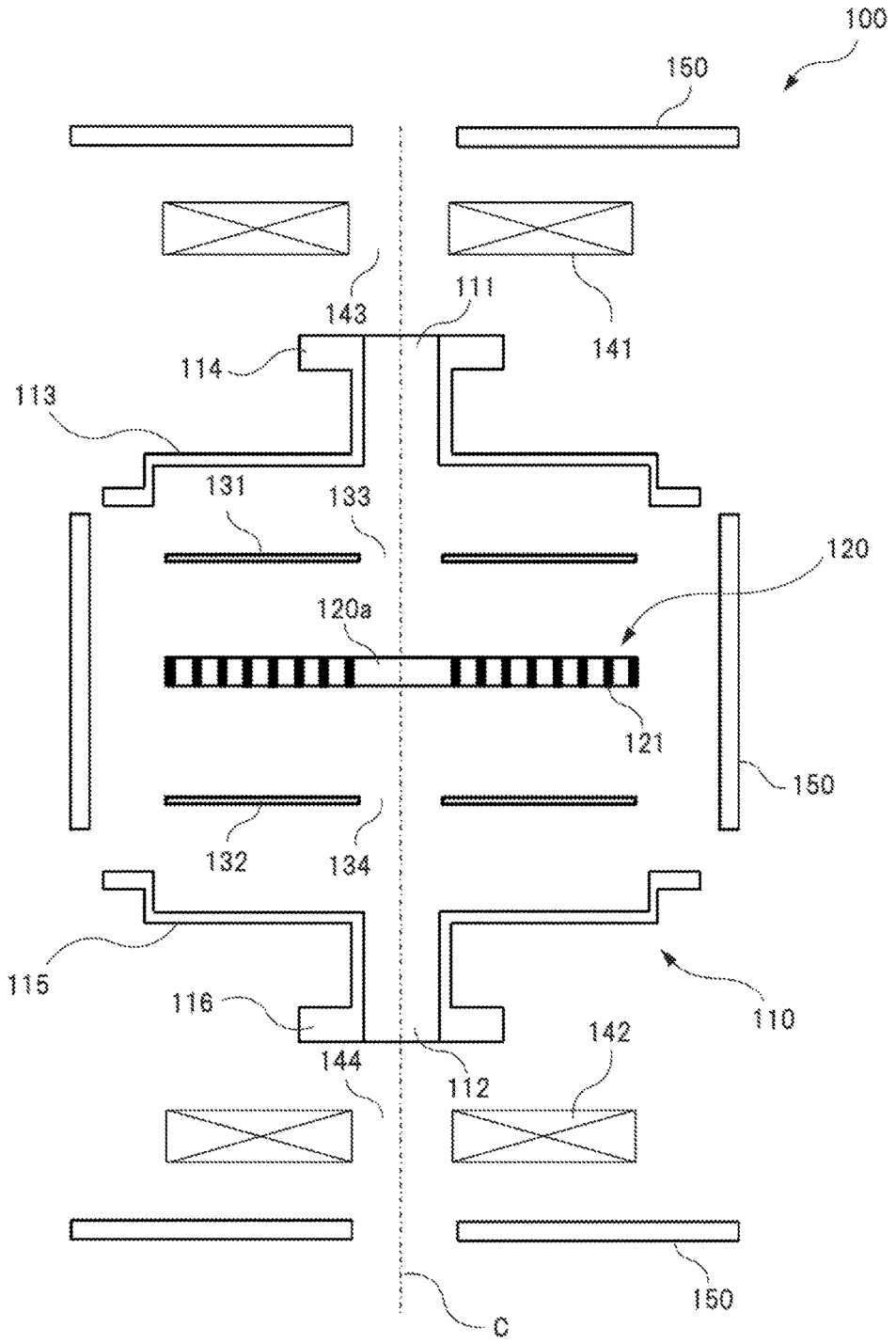
FIG. 2 is an exploded view illustrating the configuration example of the ion pump.

FIG. 1 illustrates the configuration example of the ion pump 100. FIG. 1 illustrates a cross-sectional view when the ion pump is seen in a plan view, and a cross-sectional view when the ion pump is seen in a side view. In addition, FIG. 2 illustrates an exploded view of the ion pump 100. As illustrated in FIGS. 1 and 2, the ion pump 100 is configured to include a casing 110, an electrode group 120, a pair of plate-shaped electrodes 131 and 132, a pair of plate-shaped magnets 141 and 142, and a magnetic shield 150. In addition, the magnetic shield 150 minimizes a leakage magnetic field to the outside, and further, forms a closed magnetic circuit together with the plate-shaped magnets 141 and 142. In the present embodiment, the casing 110, and the pair of plate-shaped magnets 141 and 142 are arranged inside the magnetic shield 150. In addition, the electrode group 120, and the pair of plate-shaped electrodes 131 and 132 are arranged inside the casing 110. In addition, external connection flanges 114 and 116 formed in the casing 110 protrude outside the magnetic shield 150. The ion pump 100 is connected to another external device via the external connection flanges 114 and 116. The external device to which the ion pump 100 is connected is, for example, a vacuum chamber, a sample chamber, or the like which is a target to be turned into a vacuum state. In addition, the external device may be another vacuum pump (an ion pump, a heating and non-evaporating getter pump, a sublimation pump, and the like).

[1-1. Casing]

The casing 110 is a frame which forms a workspace configured to collect gas molecules or to house a sample and experimental equipment or causing the sample and the experimental equipment to pass therethrough. As illustrated in FIG. 1, the electrode group 120 and the pair of plate-shaped electrodes 131 and 132 are arranged inside the casing 110. In the present invention, a main body portion to form a space in which the electrode group 120, and the pair of plate-shaped electrodes 131 and 132 are arranged in the casing 110 preferably has a thin disk shape. That is, the main body portion of the casing 110 is preferably a shape which is formed to have a length (width) in a direction (hereinafter, referred to also as the "orthogonal direction") orthogonal to the central-axis direction that is longer than a length (thickness) in the central-axis (C) direction. In this manner, it is possible to reduce the overall size of the ion pump 100 in the central-axis direction by forming the main body portion of the casing 110 in the thin disk shape.

A space formed in the periphery of the central axis of the casing 110 serves not only as a gas flow path in an exhaust operation but also as the space configured to house the sample and the experimental equipment or to cause the sample and the experimental equipment to pass therethrough. The casing 110 includes at least one opening (111 or 112). A gas flows inside or outside the casing 110 via the opening (111 or 112). In the embodiment illustrated in FIG. 1, the casing 110 includes the two openings 111 and 112. However, the casing 110 does not necessarily include two openings, and one opening thereof may be occluded. In the specification of the present application, the two upper and lower openings 111 and 112 are formed in the casing 110 in order to describe the ion pump 100 which is extensible in multiple stages in the up-and-down direction.

As illustrated in FIG. 1, the casing 110 is configured of an upper casing member 113 and a lower casing member 115. That is, when the upper casing member 113 and the lower casing member 115 are bonded to each other, a space configured to house the electrode group 120 and the pair of plate-shaped electrodes 131 and 132 is formed. Incidentally, when the upper casing member 113 and the lower casing member 115 are bonded to each other, flange portions formed in the respective casing members 113 and 115 can be butted and bonded to each other.

In addition, the upper casing member 113 includes the upper external connection flange 114, the lower casing member 115 includes the lower external connection flange 116. Further, the upper opening 111 is formed in the upper external connection flange 114, and the lower opening 112 is formed in the lower external connection flange 116. Accordingly, it is possible to connect an external device to both upper and lower sides of the ion pump 100 via the external connection flanges 114 and 116.

In addition, as illustrated in FIG. 1, both the upper opening 111 and the lower opening 112 are formed on the central axis (C) in the casing 110 as illustrated in FIG. 1. Accordingly, the upper external connection flange 114 and the lower external connection flange 116 are also formed on the central axis (C). Accordingly, the flow path passing from the upper opening 111 through the lower opening 112 is linearly formed in the casing 110.

Incidentally, a known material such as aluminum, titanium and stainless is used as a material of the casing 110. In addition, the casing 110 can also cause an inner wall of the casing 110 to directly function as an electrode. In this regard, the casing 110 is preferably made of aluminum with titanium vapor-deposited on the inner wall surface thereof. In this manner, it is possible to decrease the weight of the ion pump system, and further, it is possible to simplify and downsize the structure of the ion pump 100. In addition, a wiring (not illustrated) or the like, configured to drive an electrode, may be provided inside the casing 110.

[1-2. Electrode Group]

The electrode group 120 is a plurality of electrodes arranged inside the casing 110. A polarity of the electrode group 120 may be positive or negative as long as it is different from each polarity of the pair of plate-shaped electrodes 131 and 132 to be described later. In addition, the electrode group 120 may be configured such that the polarity thereof can be changed. However, the polarity of the electrode group 120 is preferably positive in the configuration of the ion pump 100 according to the present embodiment.

Figure 3:
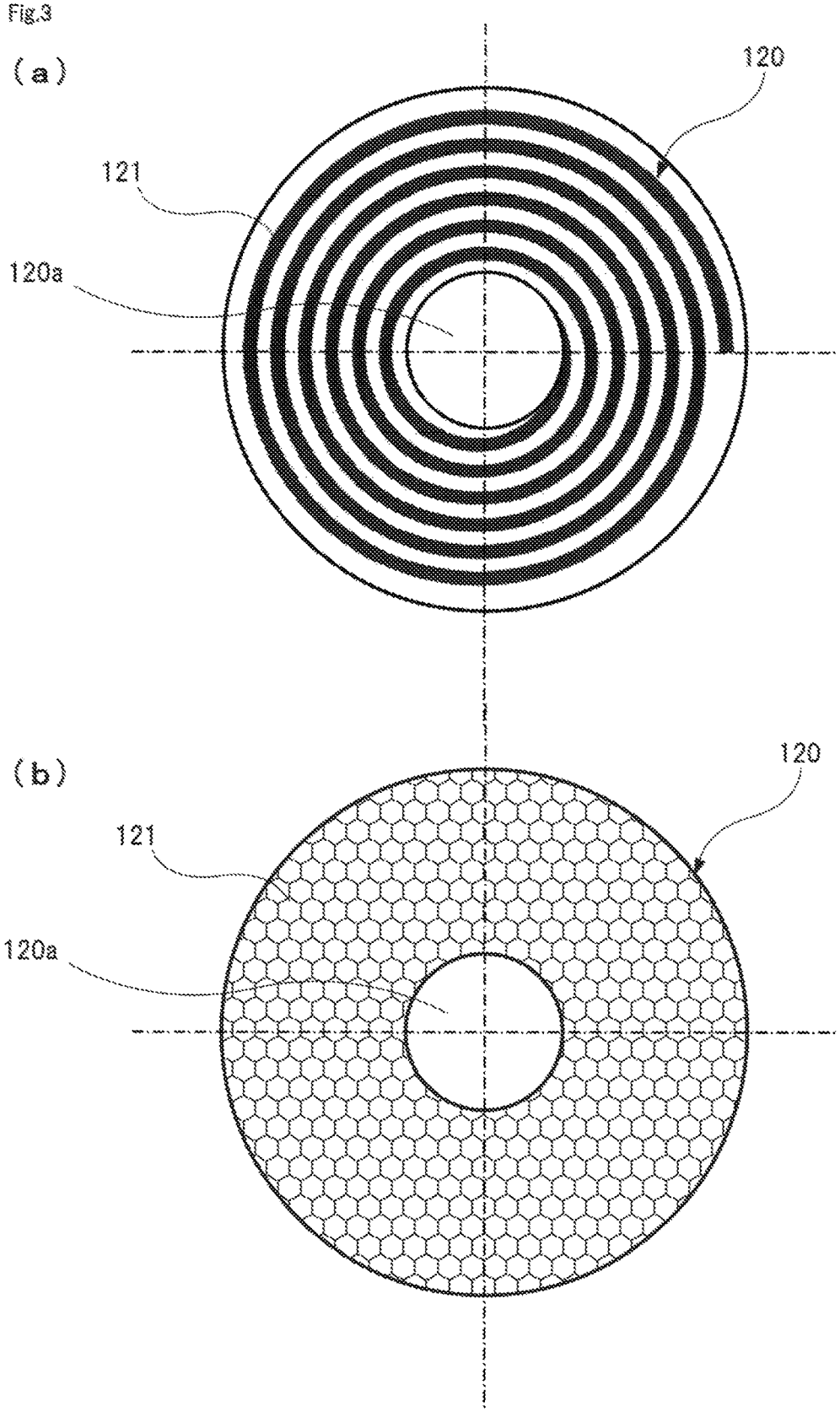
FIGS. 3(*a*) and 3(*b*) are other examples of a structure of an electrode group.

As illustrated in FIG. 1, the electrode group 120 is configured to include electrodes 121 connected at intervals. For example, the electrode group 120 may be formed by connecting the plurality of electrodes 121 at intervals, or the electrode group 120 may be formed by forming a plurality of holes in one electrode. Accordingly, the electrode group 120 keeping the space is formed. In the example illustrated in FIG. 1, each of the plurality of electrodes 121 forming the electrode group 120 is formed in a ring shape. In particular, the electrode 121 is preferably a circular ring shape (ring shape). However, the electrode 121 may be a triangular ring shape, a square ring shape, or another polygonal ring shape. In addition, FIGS. 3(*a*) and 3(*b*) illustrate other examples of the shape of the electrode group 120. As illustrated in FIG. 3(*a*), the electrode group 120 may be formed by making the electrode 121 in a spiral shape. In addition, the electrode group 120 may be formed by making the electrode 121 in a honeycomb shape (hexagonal lattice shape) as illustrated in FIG. 3(*b*). However, the example of the structure of the electrode group 120 is not limited to the drawings, and any shape can be employed as long as the shape keeps the space at the internal portion thereof by connecting the electrodes 121 at intervals. In addition, the electrode group 120 may be configured to include a hollow electrode 123 housing the electrode 121 at an internal portion thereof as will be described later.

In addition, a center opening 120*a* is formed in the electrode group 120 along the central axis (C) thereof as illustrated in FIGS. 1, 3(*a*) and 3(*b*). Thus, when the electrode group 120 is formed using the plurality of ring-shaped electrodes 121, the plurality of ring-shaped electrodes 121 are concentrically arranged with the central axis (C) as the center thereof as in the example illustrated in FIG. 1. Hereinafter, a description will be given by exemplifying a case in which the electrode group 120 is formed using a plurality of electrodes having the ring shape (hereinafter, referred to as the "ring-shaped electrodes") as an example of the ion pump according to the present invention.

As illustrated in FIGS. 1 and 2, the electrode group 120 has the shape which is formed such that the length (width) in the orthogonal direction is longer than the length (thickness) in the central-axis (C) direction. That is, the electrode group 120 is formed in a thin type which has a thin thickness. In particular, the electrode group 120 configured of the plurality of ring-shaped electrodes 121 preferably has the length (width) in the orthogonal direction which is longer than 5 or 10 times or more, or is more preferably 5 to 30 times, or most preferably 10 to 25 times of the length (thickness) in the central-axis (C) direction.

In addition, the plurality of ring-shaped electrodes 121 formed in the circular ring shape are respectively arranged like concentric circles with the central axis (C) as the center thereof. That is, one the ring-shaped electrode 121 is arranged in an opening of another the ring-shaped electrode 121, and this another the ring-shaped electrode 121 is arranged in an opening of the other the ring-shaped electrode 121. In this manner, the plurality of ring-shaped electrodes 121 share the central axis. In addition, it is preferable that the intervals among the plurality of ring-shaped electrodes 121 be practically equal intervals. In addition, the number of the ring-shaped electrodes 121 forming the electrode group 120 is not particularly limited, and may be about, for example, 5 to 20 or 8 to 15.

In addition, the electrode group 120 includes a conducting wire 122 which extends in the direction orthogonal to the central-axis (C) direction in order to connect the plurality of ring-shaped electrodes 121 as illustrated in FIG. 1. In the example illustrated in FIG. 1, the conducting wire 122 is provided in four places. The conducting wire 122 electrically connects the ring-shaped electrodes 121 forming the electrode group 120 to each other. When the plurality of ring-shaped electrodes 121 are connected via the conducting wire 122 in this manner, the respective the ring-shaped electrodes 121 can be maintained in the same polarity. In addition, it is unnecessary to apply a voltage to each of the ring-shaped electrodes 121 by connecting the plurality of ring-shaped electrodes 121 via the conducting wire 122. That is, when a voltage is applied to at least one of the ring-shaped electrodes 121, the voltage is applied to all the ring-shaped electrodes 121 via the conducting wire 122. In addition, the conducting wire 122 may function as a spacer configured to hold the interval between the respective ring-shaped electrodes 121 to be constant. When the conducting wire 122 is configured to function as the spacer in this manner, it is possible to simplify the configuration inside the electrode group 120.

In addition, the number of the ring-shaped electrodes 121 forming the electrode group 120 can be appropriately increased. It is possible to increase the exhaust amount of the ion pump 100 by increasing the number of the ring-shaped electrodes 121. In addition, when the number of the ring-shaped electrodes 121 is increased, the size of the ion pump 100 in the direction orthogonal to the central-axis direction (the orthogonal direction) is extended, but the size thereof in the central-axis direction does not change. Thus, it is possible to improve the exhaust amount while suppressing the size of the ion pump 100 in the central-axis direction to be small by increasing the number of the ring-shaped electrodes 121 in the configuration of the present invention. In this manner, the exhaust amount of the ion pump 100 can be adjusted by the extensibility in the orthogonal direction.

A known material can be appropriately used for the ring-shaped electrode 121 forming the electrode group 120. Examples of the material of the ring-shaped electrode 121 may include titanium, copper, graphite, and copper tungsten. In particular, the ring-shaped electrode 121 is preferably made of titanium when being configured to function as the negative electrode. In addition, the electrode group 120 may be arranged inside the casing 110 via a known fixing unit (not illustrated). For example, a protrusion may be formed in an outermost layer of the electrode group 120 so as to be fit in a groove formed in the casing 110.

Figure 21:
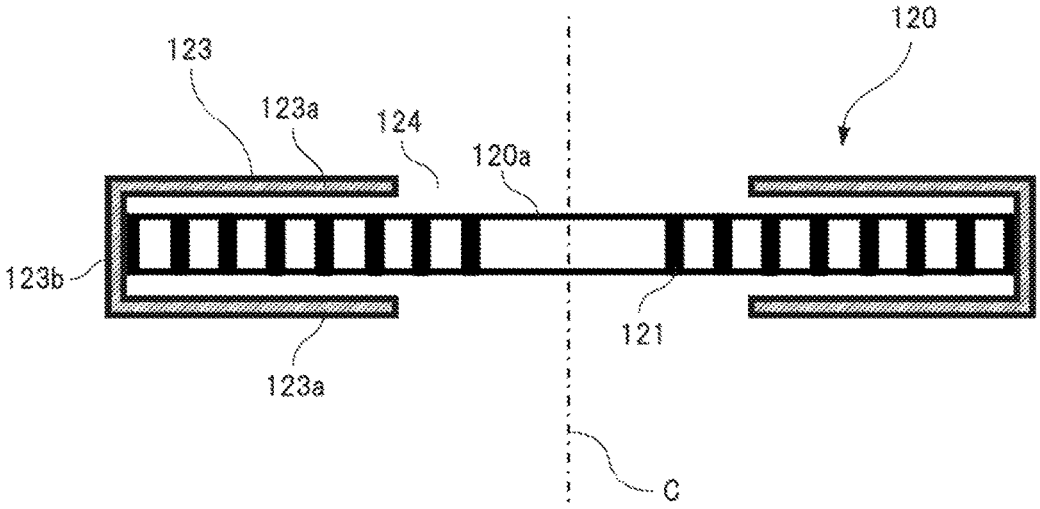
FIG. 21 is a cross-sectional view illustrating another form of the electrode group.

Further, FIG. 21 illustrates another form of the electrode group 120. The electrode group 120 illustrated in FIG. 21 includes the hollow electrode 123 in addition to the electrode 121. That is, the electrode group 120 is configured such that the plurality of electrodes 121 connected at intervals are housed inside the hollow electrode 123 which has a space formed at an internal portion thereof.

To be specific, the hollow electrode 123 includes upper and lower flat surface portions 123*a*, and a side surface portion 123*b* which connects side edges of the upper and lower flat surface portions 123*a* in the vertical direction. The space is secured between the upper and lower flat surface portions 123*a* by the side surface portion 123*b*. In this manner, the hollow electrode 123 is formed in a hollow shape to keep the space at the internal portion thereof. In addition, a center opening 124 is formed along the central axis (C) in the hollow electrode 123. Further, the electrodes 121 connected at intervals are housed in the internal portion of the hollow electrode 123, that is, the space between the upper and lower flat surface portions 123*a* as illustrated in FIG. 21. Incidentally, the electrode 121 arranged in the internal portion of the hollow electrode 123 may be the ring shape (the circular ring shape, the square ring shape, and the like), the spiral shape, or the honeycomb shape (hexagonal lattice shape) described above. In this manner, the electrode group 120 may have the structure that includes the hollow electrode 123 in addition to the electrode 121.

In addition, it is preferable that the electrode 121 and the hollow electrode 123 be electrically connected to each other as illustrated in FIG. 21. Accordingly, when a voltage is applied to any one of the electrode 121 and the hollow electrode 123, it is possible to maintain the polarity of the entire electrode group 120 to be the same. For example, it is preferable that the hollow electrode 123 be electrically connected to the electrode 121 in the side surface portion 123*b*. However, it is also possible to electrically connect the hollow electrode 123 and the electrode 121 via other portions or parts.

In addition, the center opening 120*a* formed at the center of the electrode group 120 and the center opening 124 formed in the hollow electrode 123 communicate with each other in the vertical direction as illustrated in FIG. 21. At this time, the center opening 124 of a middle-penetrating electrode 123 is preferably formed to have a larger opening diameter than the center opening 120*a* of the electrode group 120. In addition, the shape of the hollow electrode 123 can be appropriately designed in accordance with each shape of the casing 110, the electrode 121, the plate-shaped electrodes 131 and 132, and the like.

[1-3. Plate-Shaped Electrode]

The plate-shaped electrodes 131 and 132 are electrodes arranged inside the casing 110 and the electrodes electrically forming a pair with the above-described electrode group 120. That is, it is necessary to form the plate-shaped electrodes 131 and 132 to have a different polarity from the electrode group 120. In addition, each polarity of the plate-shaped electrodes 131 and 132 may be appropriately changed according to the polarity of the electrode group 120. However, each polarity of the plate-shaped electrodes 131 and 132 is preferably negative in the configuration of the ion pump 100 according to the present embodiment.

As illustrated in FIG. 1, at least a pair of the plate-shaped electrodes 131 and 132 is provided such that the electrode group 120 is sandwiched therebetween from both sides in the central-axis direction (up-and-down direction). That is, the one plate-shaped electrode 131 is arranged at the upper side of the electrode group 120, and the other plate-shaped electrode 132 is arranged at the lower side of the electrode group 120. Each thickness of the pair of upper and lower plate-shaped electrodes 131 and 132 is extremely thin. In addition, each width (length in the orthogonal direction) of the pair of plate-shaped electrodes 131 and 132 is practically equal to that of the electrode group 120. That is, the plate-shaped electrodes 131 and 132 are formed to have a horizontal width which enables the electrode group 120 to be entirely covered from the upper and lower sides. In addition, the plate-shaped electrodes 131 and 132 preferably have a disk shape. However, the plate-shaped electrodes 131 and 132 may have a triangular plate shape, a square plate shape, or other polygonal plate shapes. Each shape of the plate-shaped electrodes 131 and 132 may be set in accordance with each shape of the casing 110 and the electrode group 120.

As illustrated in FIG. 2, the center openings 133 and 134 are formed in the respective central portions of the pair of plate-shaped electrodes 131 and 132. It is preferable that each size of the center openings 133 and 134 be substantially the same size as a size of the opening of the ring-shaped electrode 121 arranged at the nearest position to the central axis (C) among the plurality of ring-shaped electrodes 121 forming the electrode group 120. Further, the pair of plate-shaped electrodes 131 and 132 are arranged such that the center openings 133 and 134 are positioned on the central axis (C), respectively, as illustrated in FIG. 2. Thus, the center openings 133 and 134 of the pair of plate-shaped electrodes 131 and 132 communicate with the opening of the electrode group 120 along the central axis (C).

A known material can be appropriately used for the plate-shaped electrodes 131 and 132. Titanium, copper, graphite, copper tungsten, or the like, which has supplemental performance with respect to residual gases in the vacuum may be appropriately used as the material the plate-shaped electrodes 131 and 132. In particular, the plate-shaped electrodes 131 and 132 are preferably made of titanium when being configured to function as the negative electrode. In addition, the plate-shaped electrodes 131 and 132 may be formed using a plate for enhancement of electric field application efficiency or punching metal for enhancement of permeability of the residual gas. In addition, the plate-shaped electrodes 131 and 132 may be arranged inside the casing 110 via a known fixing unit (not illustrated). For example, a protrusion may be formed in the plate-shaped electrodes 131 and 132 so as to be fit into a groove formed in the casing 110.

[1-4. Plate-Shaped Magnet]

The pair of plate-shaped magnets 141 and 142 is a magnet that applies a magnetic field inside the casing 110. Thus, the plate-shaped magnets 141 and 142 are arranged at the positions such that the pair of plate-shaped electrodes 131 and 132 is sandwiched therebetween from both the sides in the up-and-down direction (central-axis direction) as illustrated in FIG. 1. That is, the one plate-shaped magnet 141 is arranged above the upper plate-shaped electrode 131, and the other plate-shaped magnet 142 is arranged below the lower plate-shaped electrode 132. The plate-shaped magnets 141 and 142 are preferably permanent magnets, but may be configured using an electromagnetic coil as a magnet. In addition, each of the pair of plate-shaped magnets 141 and 142 has different magnetism between one side and the miscellaneous sides, and it is necessary for the plate-shaped magnets 141 and 142 opposing each other to be arranged such that polarities of faces opposing each other are different from each other.

As illustrated in FIG. 1, the pair of plate-shaped magnets 141 and 142 is preferably arranged outside the casing 110. However, it is also possible to be arranged the pair of plate-shaped magnets 141 and 142 inside the casing 110. When the plate-shaped magnets 141 and 142 are arranged outside the casing 110, the upper plate-shaped magnet 141 may be fixed to the upper casing member 113, and the upper plate-shaped magnet 142 may be fixed to the lower casing member 115. To be specific, each of the plate-shaped magnets 141 and 142 is preferably arranged between the main body portion (portion forming a housing space of the electrode group 120 or the like) of the casing 110 and each of the external connection flanges 114 and 116.

The pair of upper and lower plate-shaped magnets 141 and 142 is formed in a thin type. That is, each of the plate-shaped magnets 141 and 142 has a shape which is formed such that a length (width) in the orthogonal direction is longer than a length (thickness) in the central-axis (C) direction. In addition, each width (length in the orthogonal direction) of the pair of plate-shaped magnets 141 and 142 is practically equal to that of the electrode group 120. That is, the plate-shaped magnets 141 and 142 are formed to have a horizontal width which enables the electrode group 120 to be entirely covered from the upper and lower sides. In addition, the plate-shaped magnets 141 and 142 preferably have a disk shape. However, the plate-shaped magnets 141 and 142 may have a triangular plate shape, a square plate shape, or other polygonal plate shapes. Each shape of the plate-shaped magnets 141 and 142 may be set in accordance with each shape of the casing 110, the electrode group 120, and the plate-shaped electrodes 131 and 132.

As illustrated in FIG. 2, the center openings 143 and 144 are formed in the respective central portions of the pair of plate-shaped magnets 141 and 142. It is preferable that each size of the center openings 143 and 144 be substantially the same size as a size of the opening of the ring-shaped electrode 121 arranged at the nearest position to the central axis (C) among the plurality of ring-shaped electrodes 121 forming the electrode group 120. Further, the pair of plate-shaped magnets 141 and 142 are arranged such that the center openings 143 and 144 are positioned on the central axis (C), respectively, as illustrated in FIG. 2. Thus, the center openings 143 and 144 of the pair of plate-shaped magnets 141 and 142 communicate with the opening of the electrode group 120 and the center openings 133 and 134 of the plate-shaped electrodes 131 and 132 along the central axis (C).

[1-5. Magnetic Shield]

The magnetic shield 150 is a shield member that houses the casing 110 and the plate-shaped magnets 141 and 142 therein and prevents the magnetism of the plate-shaped electrodes 131 and 132 from leaking to the outside, and works to suppress the magnetic field leakage to the work-space around the central axis and suppress disturbance of a magnetic flux intruding into the electrode group 120 by forming the closed magnetic circuit together with the plate-shaped magnets 141 and 142. The magnetic shield 150 can be formed using a known material having high magnetic permeability such as mu metal and permalloy. In addition, the magnetic shield 150 is preferably conductive.

In addition, an opening is formed in a part of the magnetic shield 150 so that the external connection flanges 114 and 116 of the casing 110 protrude through the opening as illustrated in FIG. 1.

Figure 4:
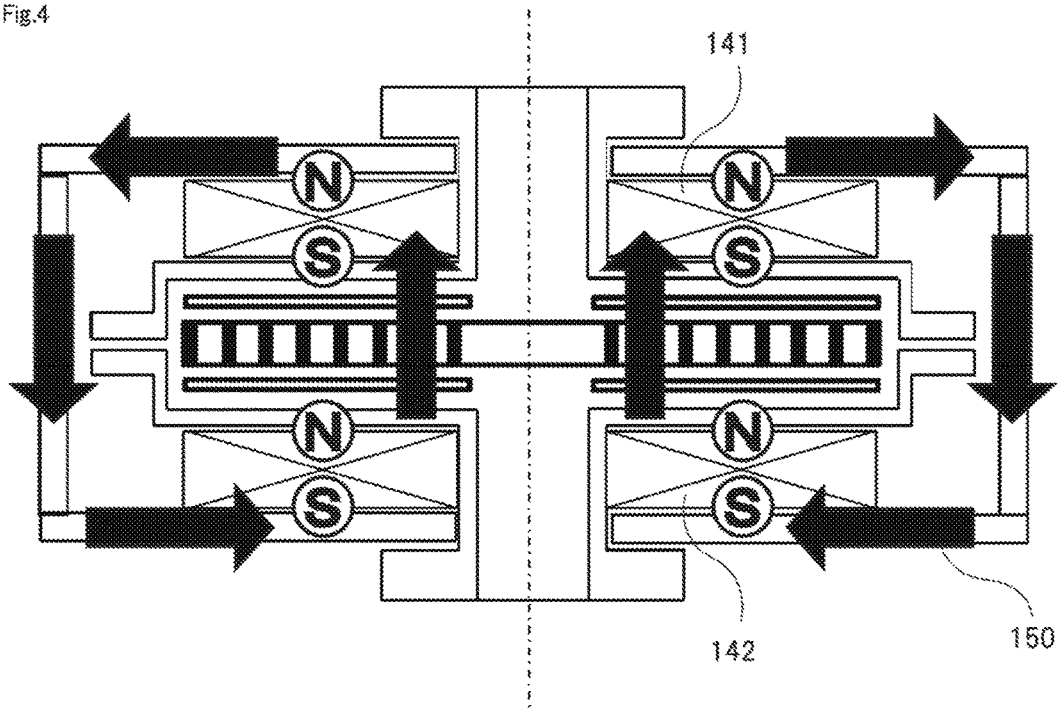
FIG. 4 illustrates concept of a closed magnetic circuit formed in the ion pump.

Further, the magnetic shield 150 preferably forms the closed magnetic circuit inside the ion pump in cooperation with the pair of plate-shaped magnets 141 and 142. The concept of the closed magnetic circuit is illustrated in FIG. 4. As illustrated in FIG. 4, the pair of plate-shaped magnets 141 and 142 each of which has the different magnetism between one side and the miscellaneous sides is used, and further, the plate-shaped magnets 141 and 142 opposing each other are arranged such that polarities of faces opposing each other are different from each other. In the example illustrated in FIG. 4, a face of the upper plate-shaped magnet 141 on the electrode group 120 side becomes the S-pole, and the opposite face becomes the N-pole. On the other hand, a face of the lower plate-shaped magnet 142 on the electrode group 120 side becomes the N-pole, and the opposite face becomes the S-pole. Incidentally, each of the upper plate-shaped magnet 141 and the lower plate-shaped magnet 142 may have the polarity opposite to the above-described polarity. In addition, the magnetic shield 150 is formed using a magnetically permeable material having high magnetic permeability.

With the above-described configuration, the magnetic shield 150 functions as a guide of the magnetic flux surrounding the periphery of the ion pump in cooperation with the pair of plate-shaped magnets 141 and 142. That is, when the magnetic flux vertically penetrating the ion pump is pulled into the magnetic shield 150, the closed magnetic circuit is formed. Accordingly, it is possible to align distribution of the magnetic flux intruding into the electrode group 120 and to reduce the leakage of the magnetic field into the space around the central axis.

The ion pump 100 configured as described above has the size which is small in the central-axis (C) direction as illustrated in FIG. 1 and the like. That is, the length in the central-axis direction is set to be smaller than the length in the direction orthogonal to the central axis (the orthogonal direction) when the overall outer shape of the ion pump 100 is viewed. To be specific, it is possible to suppress the length of the ion pump 100 of the present invention in the central-axis direction to be about ¼ of that of an ion pump of the related art.

In addition, the ion pump 100 of the present invention has the small size in the central-axis direction as described above, but basic performances thereof such as the exhaust amount can be maintained as performances which are not changed from the related art. That is, it is possible to sufficiently secure the space to collect the gas by increasing the number of the ring-shaped electrodes 121 forming the electrode group 120 and extending each length (width) of the casing 110, the plate-shaped electrodes 131 and 132, and the plate-shaped magnets 141 and 142 in the orthogonal direction in accordance with the increased number. Therefore, the ion pump 100 can obtain the desired exhaust performance while suppressing the size in the central-axis direction.

[1-6. Voltage Supply Method]

Figure 5:
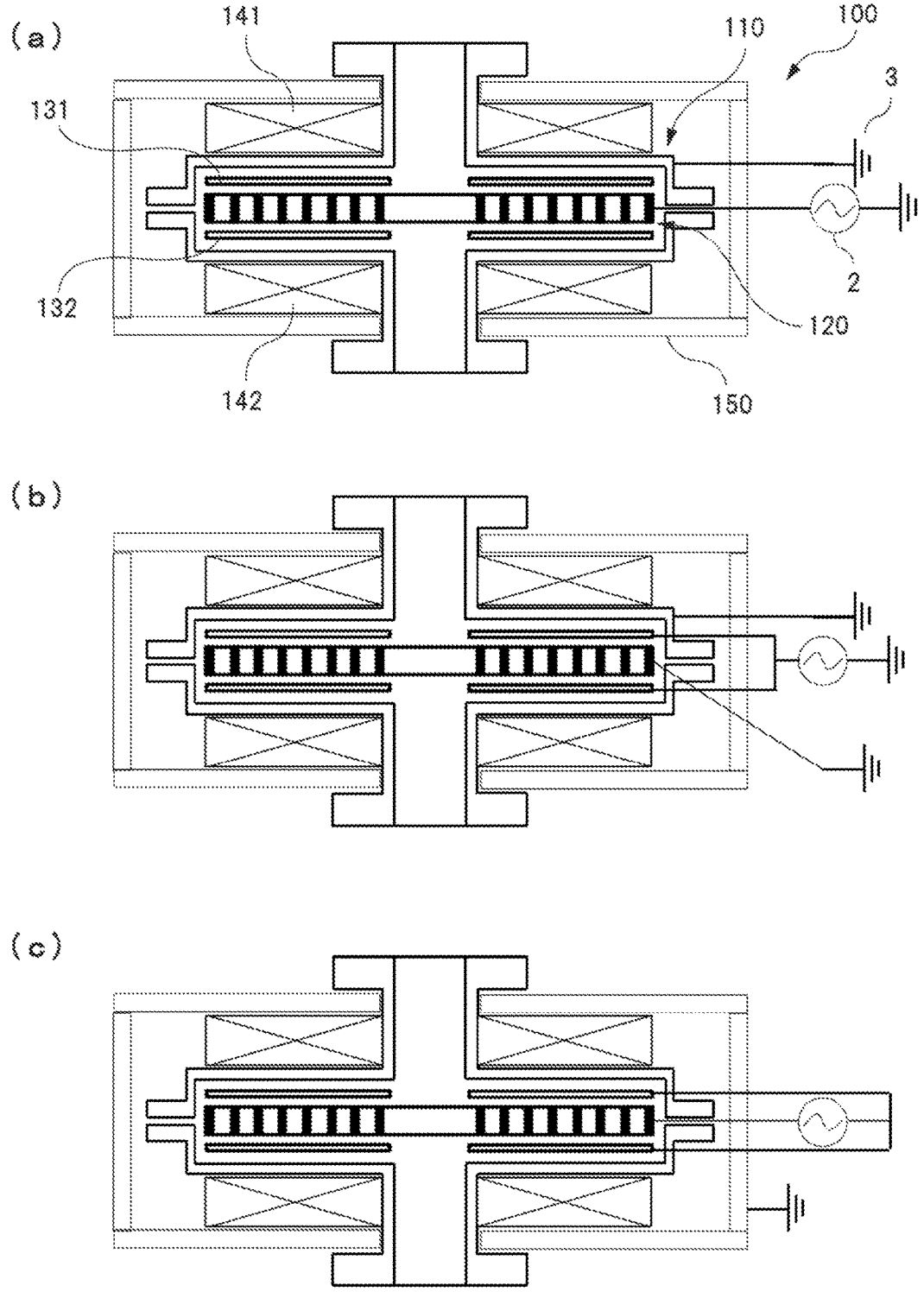
FIGS. 5(*a*) to 5(*c*) illustrate examples of a method of supplying a voltage to an electrode of the ion pump.

FIGS. 5(*a*) to 5(*c*) illustrate examples of modes of connecting a power supply 2 to the ion pump 100 having the above-described configuration.

For example, FIG. 5(*a*) illustrates an example in which the power supply 2 is connected to the electrode group 120 and a voltage is applied to the electrode group 120. In this case, it is possible to connect an earth 3 to the casing 110. Incidentally, the casing 110 is connected to the pair of plate-shaped electrodes 131 and 132. Thus, the electrode group 120 serves as the positive electrode, and the plate-shaped electrodes 131 and 132 and the casing 110 serve as the negative electrodes in the example illustrated in FIG. 5(*a*).

In addition, FIG. 5(*b*) illustrates an example in which the power supply 2 is connected to the pair of plate-shaped electrodes 131 and 132 and a voltage is applied to the plate-shaped electrodes 131 and 132. In this case, it is possible to connect the earth 3 to the casing 110 and the electrode group 120. In the example illustrated in FIG. 5(*b*), the pair of plate-shaped electrodes 131 and 132 serves as the positive electrode, and the casing 110 and the electrode group 120 serves as the negative electrodes.

In addition, FIG. 5(*c*) illustrates an example in which a positive side of the power supply 2 is connected to one of the electrode group 120 and the plate-shaped electrodes 131 and 132, and a negative side of the power supply 2 is connected to the other one of the electrode group 120 and the plate-shaped electrodes 131 and 132. In this case, it is possible to connect the earth 3 to the magnetic shield 150. In addition, the earth 3 may be connected to the casing 110 although not illustrated. In the example illustrated in FIG. 5(*c*), one of the electrode group 120 and the plate-shaped electrodes 131 and 132 serve as the positive electrodes, and the other serves as the negative electrode in the direction in which current flows from the power supply 2. Which one is set as the positive electrode or the negative electrode can be changed by controlling the direction of the current to be supplied from the power supply 2. Thus, a control device (not illustrated) configured to control the power supply 2 may be provided in the example illustrated in FIG. 5(*c*).

[1-7. Multi-Stage Structure of Ion Pump]

One of the characteristics of the ion pump 100 having the above-described structure is that it is possible to stack the ion pumps 100 in a plurality of stages in the central-axis (C) direction. That is, the ion pump 100 has the extensibility in the central-axis direction.

Figure 6:
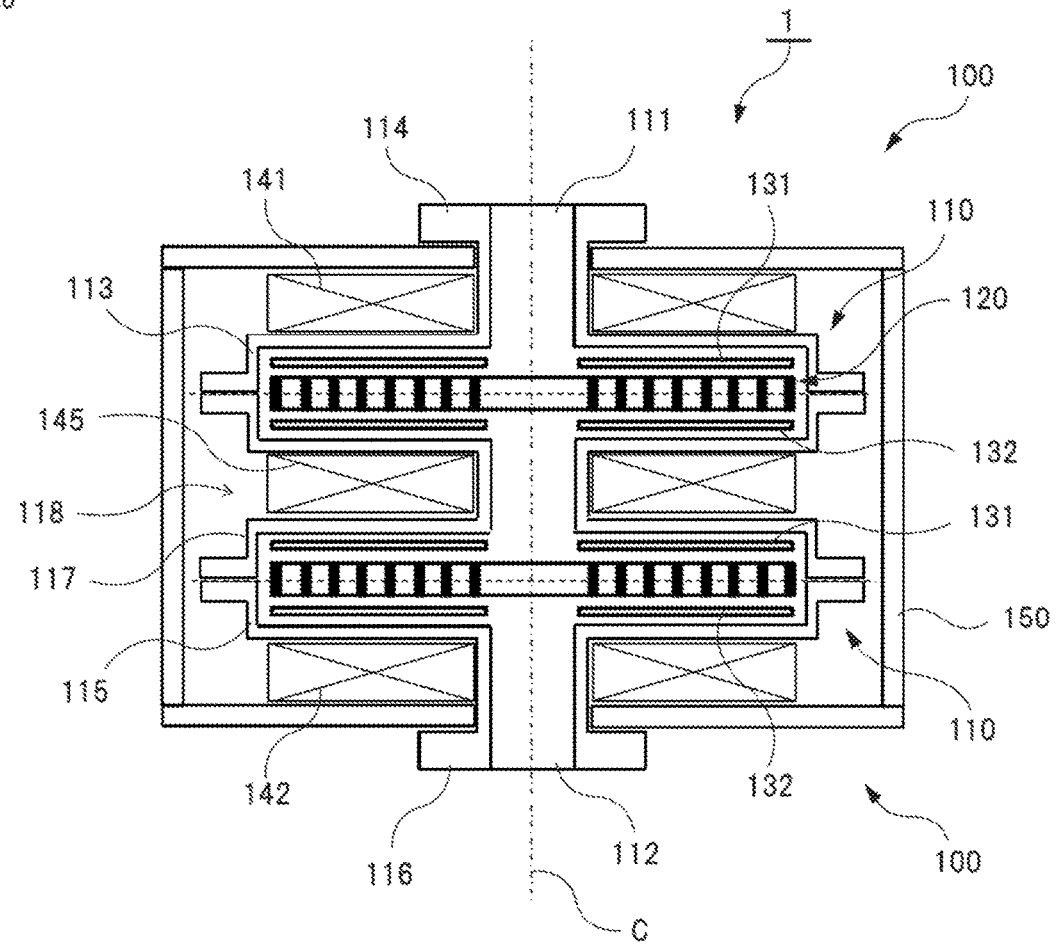
FIG. 6 is a cross-sectional view illustrating a configuration example of ion pumps stacked in two stages.
Figure 7:
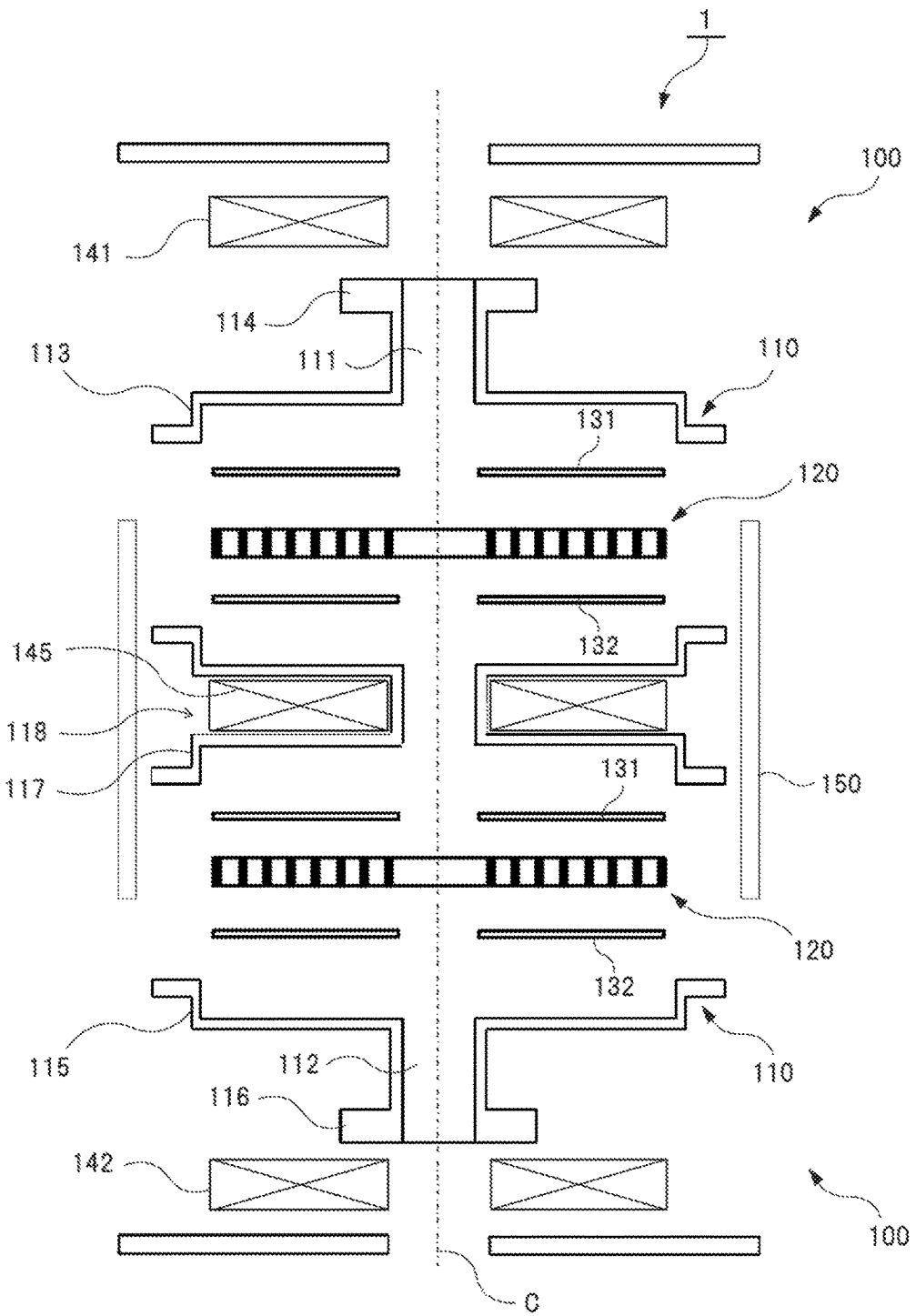
FIG. 7 is an exploded view illustrating the configuration example of the ion pumps stacked in two stages.

FIG. 6 illustrates an example of a structure in which the ion pumps 100 are stacked in two stages. In addition, FIG. 7 illustrates an exploded view of the structure in which the ion pumps 100 are stacked in two stages. As illustrated in FIGS. 6 and 7, the ion pump 100 includes the casing 110, the electrode group 120, the pair of plate-shaped electrodes 131 and 132, and the pair of plate-shaped magnets 141 and 142 as the basic configuration. Incidentally, the magnetic shield 150 is preferably formed in a shape that can cover all the stacked ion pumps 100 when the ion pumps 100 are stacked.

As illustrated in FIG. 6, the two stacked ion pumps 100 share the central axis (C). That is, a columnar space is formed along the single central axis (C) by the two ion pumps 100. Thus, it is possible to secure the space configured to house the experimental equipment or cause the experimental equipment to pass therethrough.

To be specific, when the ion pumps 100 are stacked, the casing 110 includes a relay casing member 117 in addition to the upper casing member 113 in which the upper external connection flange 114 is formed and the lower casing member 115 in which the lower external connection flange 116 is formed. The relay casing member 117 is arranged between the upper casing member 113 and the lower casing member 115. The relay casing member 117 is bonded to the upper casing member 113, thereby functioning as the casing 110 for the ion pump 100 at the upper stage. At the same time, the relay casing member 117 is bonded to the lower casing member 115, thereby also functioning as the casing 110 for the ion pump 100 at the lower stage. Incidentally, when the relay casing member 117 is bonded to the upper casing member 113 and the lower casing member 115, flange portions formed in the respective casing members 113, 115 and 117 can be butted and bonded to each other. In this manner, it is possible to make the overall size of the ultra-high vacuum creating device 1 in the central-axis direction compact by providing the relay casing member 117 that can be shared between the upper-stage ion pump 100 and the lower-stage ion pump 100.

In addition, a constricted portion 118 that is inwardly constricted is formed in a central portion of the relay casing member 117 in the central-axis direction as illustrated in FIG. 6 and the like. A plate-shaped magnet 145 (141 or 142) is arranged in the constricted portion 118 of the relay casing member 117.

In addition, when the ion pumps 100 are stacked, the upper-stage ion pump 100 and the lower-stage ion pump 100 can share the plate-shaped magnet 145 (141 or 142). Originally, the ion pump 100 is provided with the pair of two plate-shaped magnets 141 and 142. However, when the ion pumps 100 are stacked in a plurality of stages, a single plate-shaped magnet can be used as the lower plate-shaped magnet 142 in the upper-stage ion pump 100 and the upper plate-shaped magnet 141 in the lower-stage ion pump 100. Thus, three plate-shaped magnets are used to realize the same function as that in the case of arranging four plate-shaped magnets in the example illustrated in FIG. 6. In the respective drawings, reference sign 145 represents the plate-shaped magnet shared by the two ion pumps 100. The shared plate-shaped magnet 145 is configured to provide a magnetic field to both the casing 110 of the upper-stage ion pump 100 and the casing 110 of the lower-stage ion pump 100. When the plate-shaped magnet 145 is shared in the case of stacking the ion pumps 100 in this manner, it is possible to make the overall size of the ultra-high vacuum creating device 1 in the central-axis direction more compact, and reduce the weight thereof. Incidentally, the shared plate-shaped magnet 145 is arranged in the constricted portion 118 of the relay casing member 117.

Figure 8:
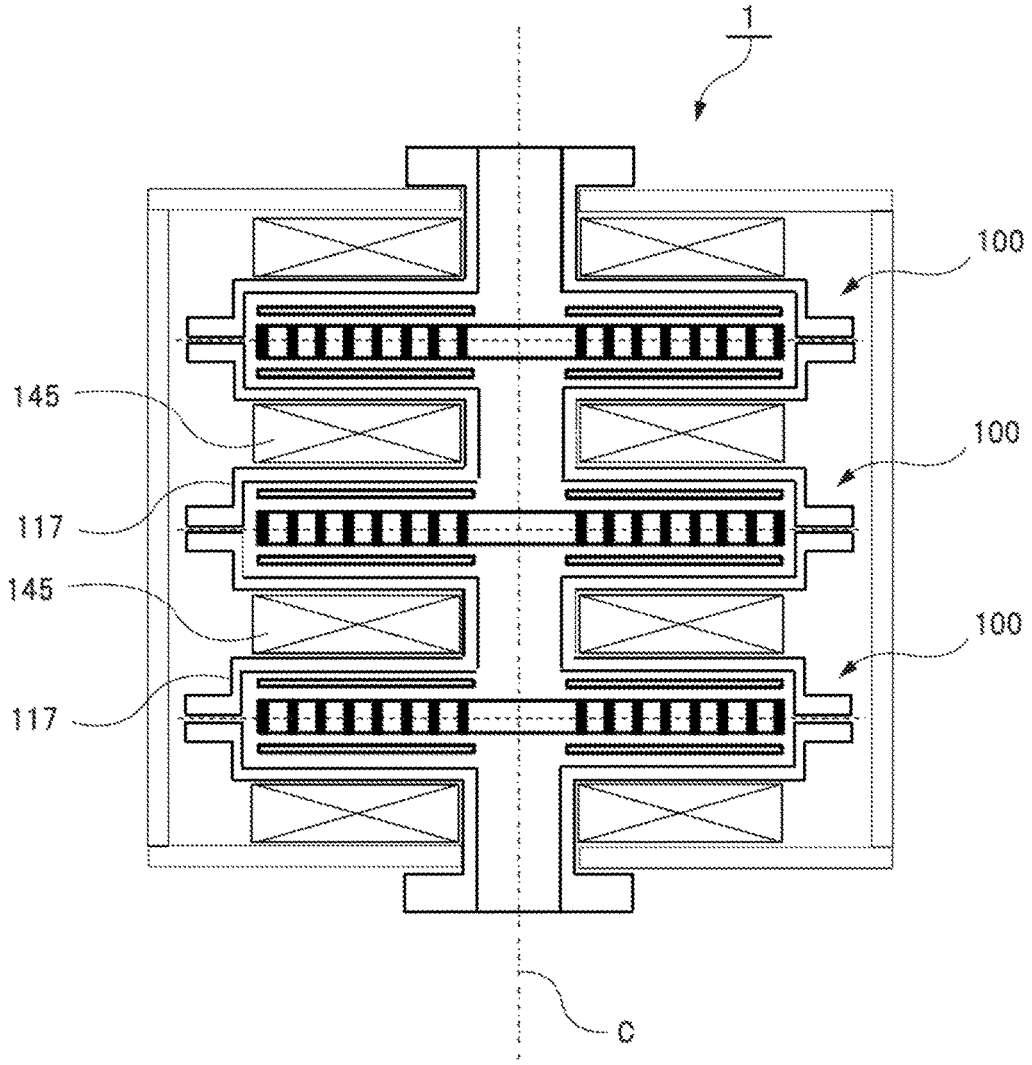
FIG. 8 is a cross-sectional view illustrating a configuration example of ion pumps stacked in three stages.

In addition, FIG. 8 illustrates a structure in which the ion pumps 100 are stacked in three stages. When the ultra-high vacuum creating device 1 is constructed by stacking the ion pumps 100 in three stages, there are the two relay casing members 117 and the two shared plate-shaped magnets 145.

Figure 9:
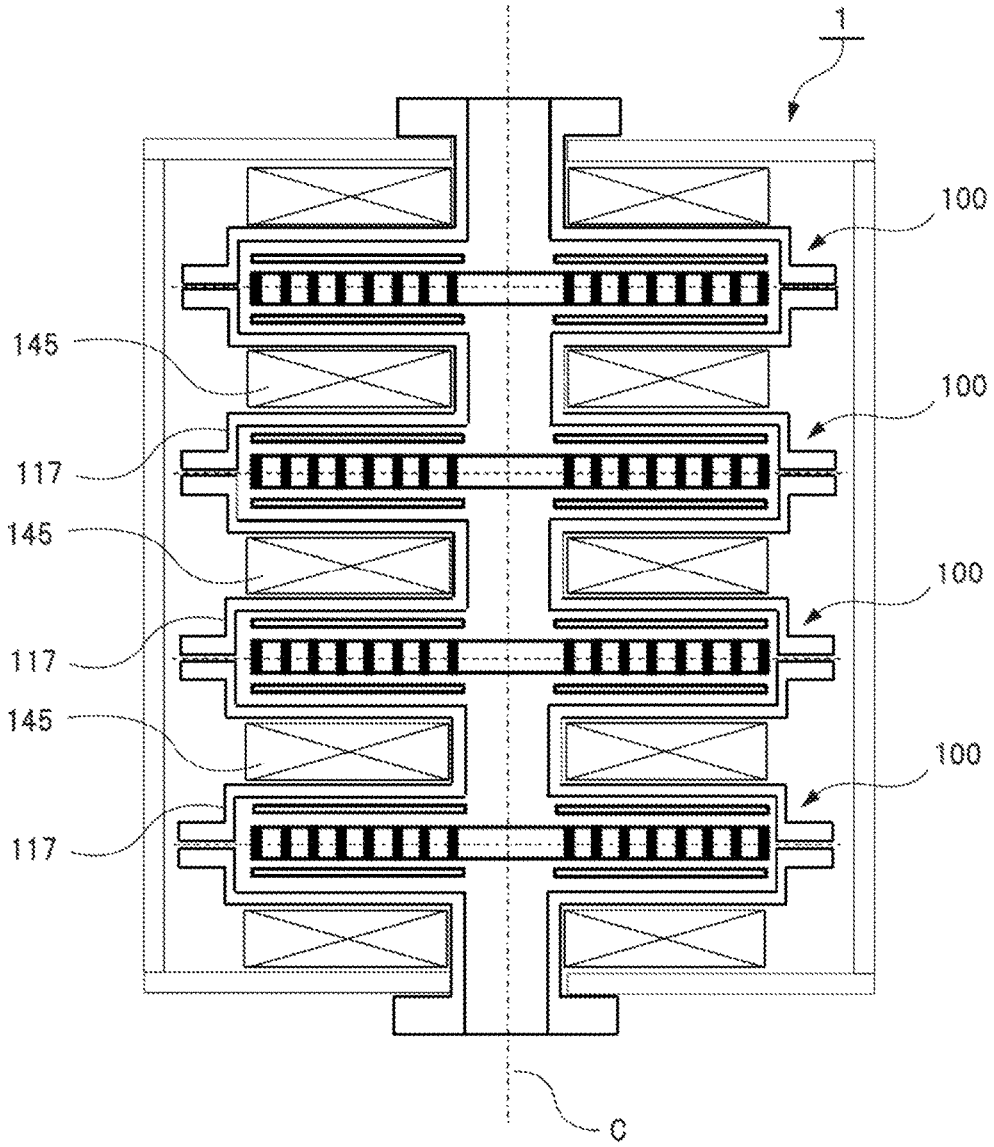
FIG. 9 is a cross-sectional view illustrating a configuration example of ion pumps stacked in four stages.

In addition, FIG. 9 illustrates a structure in which the ion pumps 100 are stacked in four stages. When the ultra-high vacuum creating device 1 is constructed by stacking the ion pumps 100 in four stages, there are the three relay casing members 117 and the three shared plate-shaped magnets 145. Incidentally, the ultra-high vacuum creating device 1 of the present invention has the size in the central-axis (C) direction that is about ¼ of that of the ion pump of the related art. Thus, when the ion pumps 100 are stacked in four stages, the size of the ultra-high vacuum creating device 1 of the present invention in the central-axis direction is just the same level as the size of the ion pump of the related art. Further, the exhaust performance of the ultra-high vacuum creating device 1 of the present invention is remarkably improved as compared to the ion pump of the related art since the ion pumps 100 are stacked in four stages.

[2. Heating and Non-Evaporating Getter Pump]

The ultra-high vacuum creating device 1 according to the present invention may be provided with a heating and non-evaporating getter pump 200 in addition to the ion pump 100. FIGS. 10 to 17 illustrate configuration examples of the heating and non-evaporating getter pump 200. The heating and non-evaporating getter pump 200 is a vacuum pump that performs exhaust by heating a surface of a getter material using radiant heat from a heater in vacuum inside a casing and activating the getter material. The operation principle of the heating and non-evaporating getter pump is that the surface of the getter material such as Ti—V—Fe and an internal portion in which gases are stored are heated in the vacuum to discharge stored and adsorbed gases, and then, a chain reaction relating to gas storage is caused by returning the temperature to room temperature, thereby realizing the function as the pump.

The ion pump 100 has an advantage that it is possible to collect an inert gas such as nitrogen, helium and argon and rapidly create the ultra-high vacuum, but has a disadvantage that exhaust efficiency regarding hydrogen as a light element molecule is poor. On the other hand, the heating and non-evaporating getter pump 200 has a disadvantage that the absolute exhaust speed and the operation in a low vacuum region are poor, but has a high exhaust performance relating to hydrogen. Thus, it is possible to complement the disadvantages of the pumps one another by combining the ion pump 100 and the heating and non-evaporating getter pump 200 like the ultra-high vacuum creating device 1 of the present invention. Therefore, it is possible to provide the ultra-high vacuum creating device 1 with the favorable usability by combining the ion pump 100 and the heating and non-evaporating getter pump 200. It is novel to provide such a uniaxially symmetric structure of the heating and non-evaporating getter pump 200 in order for series-connection with another pump.

Figure 10:
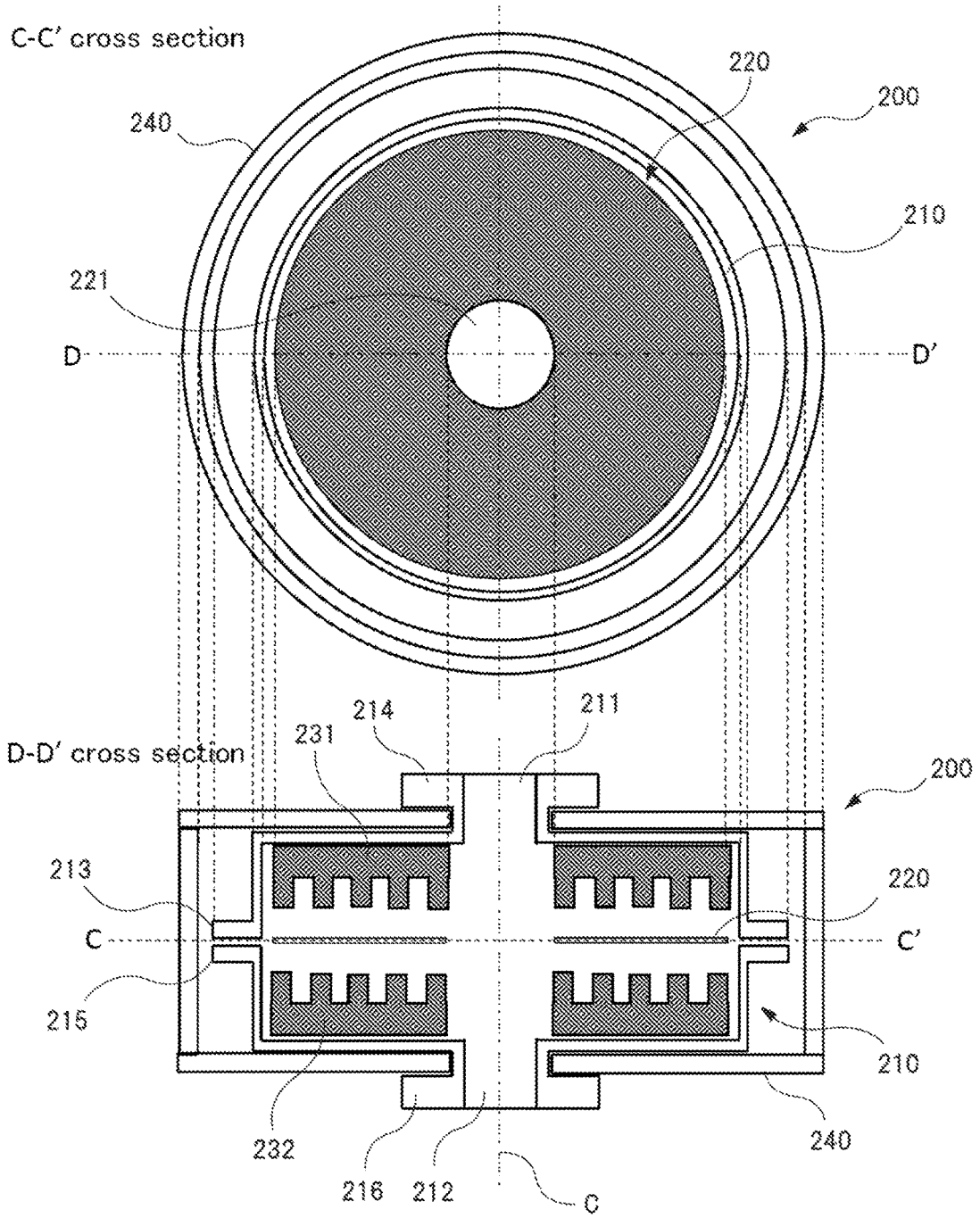
FIG. 10 is a cross-sectional view illustrating a configuration example of a heating and non-evaporating getter pump.
Figure 11:
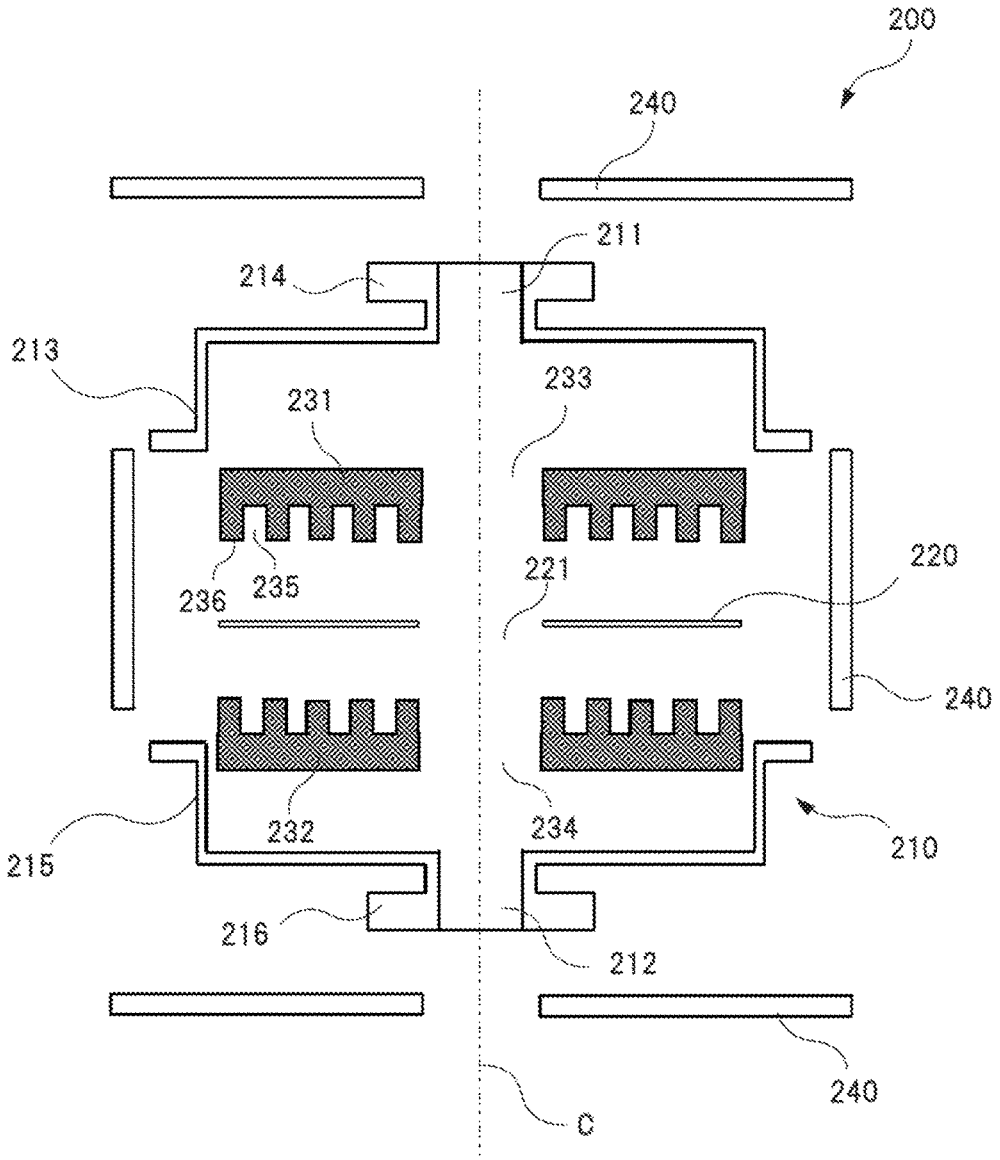
FIG. 11 is an exploded view illustrating the configuration example of the heating and non-evaporating getter pump.

FIG. 10 illustrates the configuration example of the heating and non-evaporating getter pump 200. FIG. 10 illustrates a cross-sectional view when the heating and non-evaporating getter pump is seen in a plan view, and a cross-sectional view when the heating and non-evaporating getter pump is seen from a side view. In addition, FIG. 11 illustrates an exploded view of the heating and non-evaporating getter pump 200. As illustrated in FIGS. 10 and 11, the heating and non-evaporating getter pump 200 is configured to include a casing 210, a heater 220, a pair of getter materials 231 and 232, and a heat shield 240. In the present embodiment, the casing 210 is arranged inside the heat shield 240. In addition, the heater 220 and the pair of getter materials 231 and 232 are arranged inside the casing 210. In addition, external connection flanges 214 and 216 formed in the casing 210 protrude outside the heat shield 240. The heating and non-evaporating getter pump 200 is connected to another external device via the external connection flanges 214 and 216. The external device to which the heating and non-evaporating getter pump 200 is connected is, for example, a vacuum chamber, a sample chamber, or the like which is a target to be turned into a vacuum state. In addition, the external device may be another vacuum pump (an ion pump, a heating and non-evaporating getter pump, a sublimation pump, and the like).

[2-1. Casing]

The casing 210 is a frame which forms a workspace configured to collect gas molecules or to house a sample and experimental equipment or causing the sample and the experimental equipment to pass therethrough. The casing 210 of the heating and non-evaporating getter pump 200 has basically the same structure as the casing 110 of the ion pump 100 described above. Thus, the description for the casing 110 of the ion pump 100 can be appropriately incorporated to the description for the casing 210 of the heating and non-evaporating getter pump 200.

That is, the casing 210 of the heating and non-evaporating getter pump 200 includes at least one opening (211 or 212). In the embodiment illustrated in FIG. 10, the casing 210 includes the two openings 211 and 212. Accordingly, the heating and non-evaporating getter pump 200 is extensible in multi stages in the up-and-down direction. In addition, a space, configured to house the heater 220 and the getter materials 231 and 232, is formed in the casing 210 by bonding the upper casing member 213 and the lower casing member 215. In addition, the upper casing member 213 includes the upper external connection flange 214, the lower casing member 215 includes the lower external connection flange 216. The upper opening 211 is formed in the upper external connection flange 214, and the lower opening 212 is formed in the lower external connection flange 216. Further, both the upper opening 211 and the lower opening 212 are formed on the central axis (C) in the casing 210. Accordingly, a flow path passing from the upper opening 211 through the lower opening 212 is linearly formed in the casing 210. A space formed in the periphery of the central axis serves not only as a gas flow path in an exhaust operation but also as the space configured to house the sample and the experimental equipment or to cause the sample and the experimental equipment to pass therethrough.

[2-2. Heater]

The heater 220 is a heat generating source configured to heat the getter materials 231 and 232 inside the casing 210. The heater 220 may be formed using a metallic material that generates heat by electrical heating when power is applied, for example. Thus, the heater 220 is preferably connected to a power supply (not illustrated). The heater 220 is heated to a degree that can cause the getter materials 231 and 232 to be heated by the radiant heat. The heating temperature of the heater 220 is not particularly limited, and for example, is 300 to 600 degree. The heating temperature of the heater 220 may be appropriately adjusted according to each material of the getter materials 231 and 232, a positional relationship therebetween, and the like.

As illustrated in FIG. 10, the heater 220 has preferably a plate shape. The plate shape indicates a shape whose width is longer than a thickness thereof. The heater 220 has preferably a disk shape, but may have a triangular plate shape a square plate shape, or other polygonal plate shapes.

In addition, the center opening 221 is formed at the central portion of the heater 220. A size of the center opening 221 may be set to the same level as the openings 211 and 212 formed in the casing 210, for example. Further, heater 220 is arranged such that the center opening 221 is positioned on the central axis (C) as illustrated in FIG. 1. Thus, the center opening 221 of the heater 220 communicates with the openings 211 and 212 of the casing 210 along the central axis (C).

[2-3. Getter Material]

The getter materials 231 and 232 are members each of which are activated when being heated by the heater 220 in the vacuum and causes gas molecules such as hydrogen to be continuously stored through the chain reactions. A known material having a getter effect and a hydrogen storage effect can be used as the getter materials 231 and 232. For example, the getter materials 231 and 232 may be made of an alloy including, for example, Ti, V, Fe and the like.

As illustrated in FIG. 10, the pair of getter materials 231 and 232 is arranged on both sides of the heater 220 in the central-axis direction (up-and-down direction). That is, one of the getter material 231 is arranged above the heater 220 and the other getter material 231 is arranged below the heater 220. The pair of getter materials 231 and 232 is formed in a thin type such that a length (width) in the orthogonal direction is longer than a length (thickness) in the central-axis direction. In addition, the getter materials 231 and 232 are preferably formed in a disk shape similarly to the heater 220. However, the getter materials 231 and 232 may have a triangular plate shape, a square plate shape, or other polygonal plate shapes, but is desirably a structure in which a face opposing the heater has an appropriately uneven structure so as to efficiently repair the radiant heat from the heater. Each shape of the getter materials 231 and 232 may be formed in accordance with each shape of the casing 210 and the heater 220.

As illustrated in FIG. 11, the center openings 233 and 234 are formed in the respective central portions of the pair of getter materials 231 and 232. Each size of the center openings 233 and 234 of the getter materials 231 and 232 is preferably set to substantially the same size as the center opening 221 formed in the heater 220. Further, the pair of getter materials 231 and 232 are arranged such that the center openings 233 and 234 are positioned on the central axis (C), respectively, as illustrated in FIG. 11. Thus, the center openings 233 and 234 of the pair of getter materials 231 and 232 communicate with the center opening 221 of the heater 220 along the central axis (C).

In addition, a plurality of concave portions 235 and a plurality of convex portions 236 are alternately formed on each face of the getter materials 231 and 232 on each side opposing the heater 220 as illustrated in FIG. 11. The concave portion 235 and the convex portion 236 are formed at equal intervals in concentric circles having the central axis (C) as the central axis thereof. That is, the concentrically circular convex portion 236 is formed between the concentrically circular concave portions 235. When the unevenness is formed on each surface of the getter materials 231 and 232 in this manner, it is possible to increase a surface area of a getter film, and thus, it is possible to enhance the efficiency of collecting gases inside the casing 210.

[2-4. Heat Shield]

The heat shield 240 is a shield member which is configured to house the casing 210 therein and to prevent heat generated by the heater 220 from leaking outside. The heat shield 240 is a member that is arbitrarily provided, but is preferably provided in order to prevent an external device from being affected by the heat. The heat shield 240 can be formed using a known material. In addition, an opening is formed in a part of the heat shield 240 so that the external connection flanges 214 and 216 of the casing 210 protrude through the opening as illustrated in FIG. 10.

[2-5. Combination of Ion Pump and Heating and Non-Evaporating Getter Pump]

Figure 12:
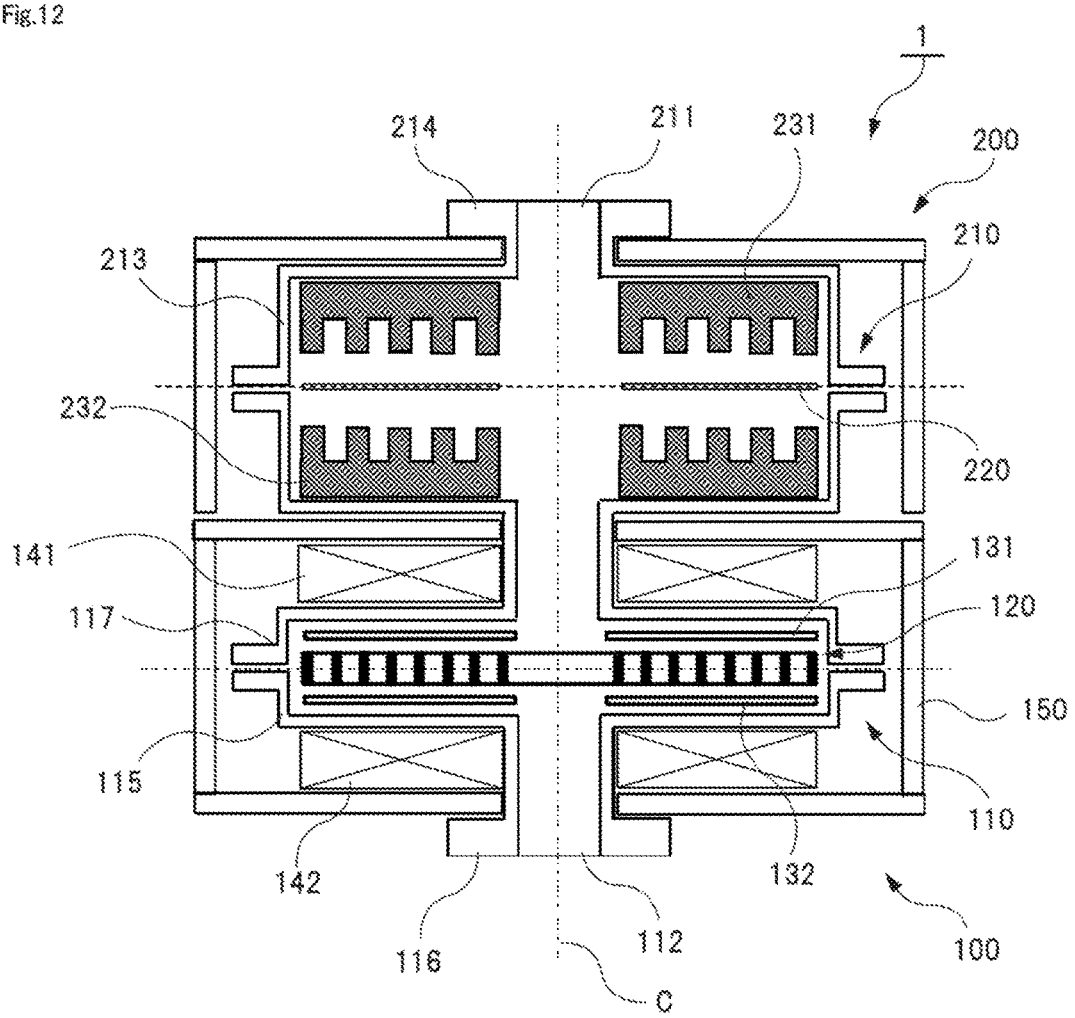
FIG. 12 is a cross-sectional view illustrating a state in which the ion pump and the heating and non-evaporating getter pump are stacked.
Figure 13:
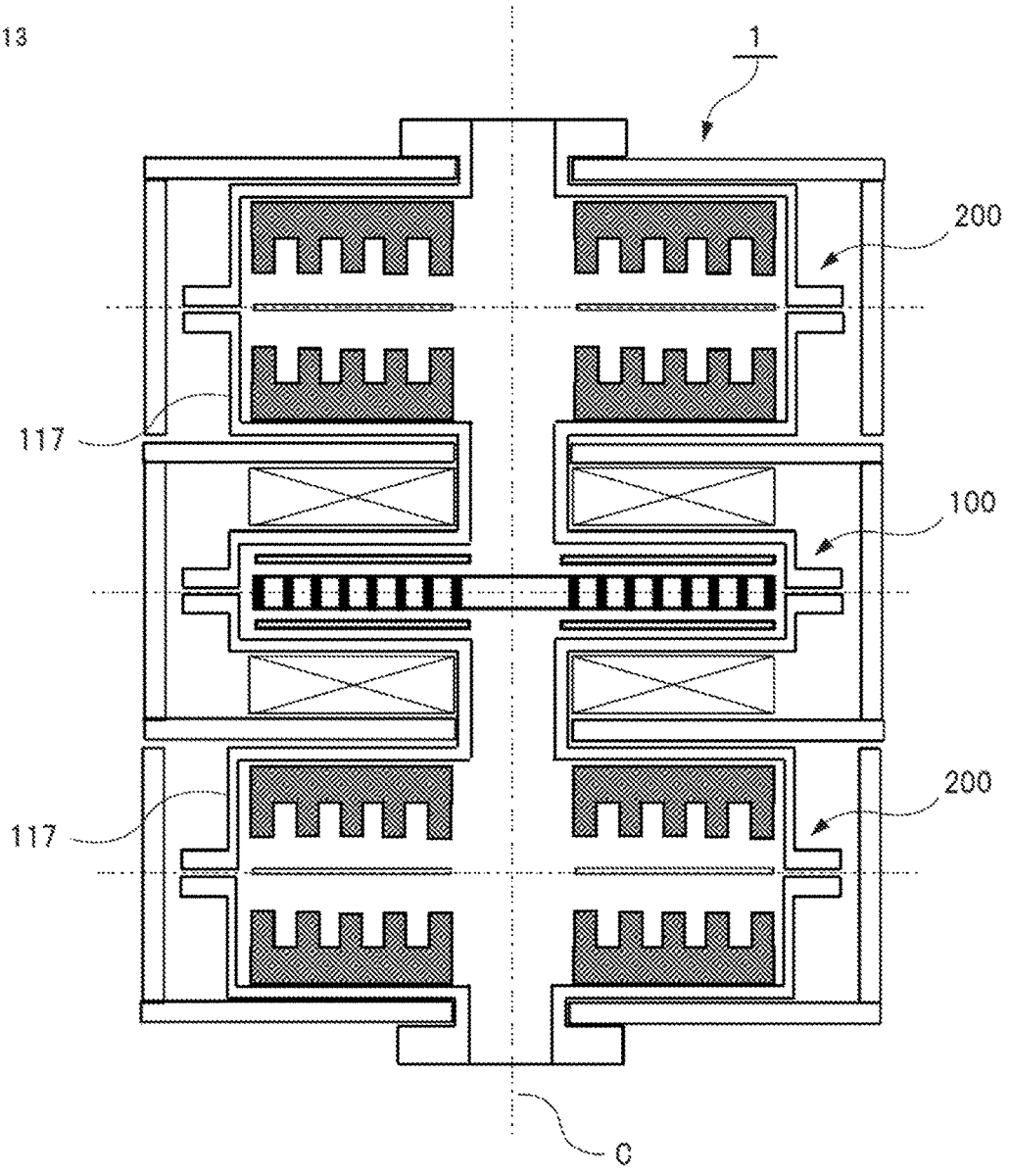
FIG. 13 is a cross-sectional view illustrating a state in which a one-stage ion pump and a two-stage heating and non-evaporating getter pump are stacked.
Figure 14:
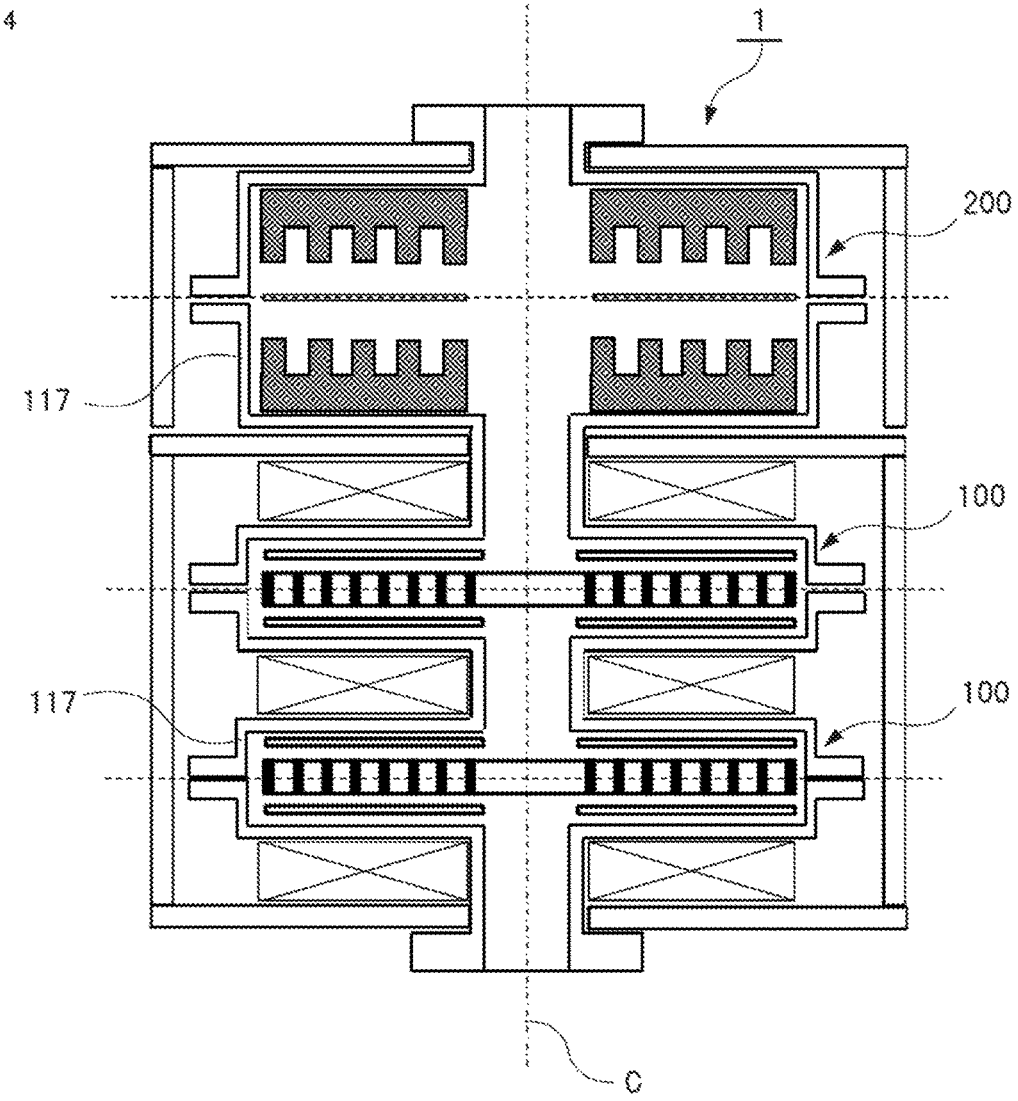
FIG. 14 is a cross-sectional view illustrating a state in which a two-stage ion pump and a one-stage heating and non-evaporating getter pump are stacked.

The heating and non-evaporating getter pump 200 having the above-described configuration can be combined with the ion pump 100 in a stacked manner. That is, the ultra-high vacuum creating device 1 of the present invention can be constructed by combining one or a plurality of ion pumps 100 and one or a plurality of heating and non-evaporating getter pumps 200. FIGS. 12 to 14 illustrates examples of the combination of the ion pump 100 and the heating and non-evaporating getter pump 200.

FIG. 12 illustrates a configuration example in which the one ion pump 100 and the one heating and non-evaporating getter pump 200 are combined. As illustrated in FIG. 12, the ion pump 100 and the heating and non-evaporating getter pump 200 share the central axis (C), and a columnar space is formed along the central axis (C). Thus, it is possible to cause the experimental equipment to be housed in or to pass through the columnar space.

To be specific, the relay casing member 117 is provided when the ion pump 100 and the heating and non-evaporating getter pump 200 are stacked. The relay casing member 117 is arranged between the upper casing member 213 of the heating and non-evaporating getter pump 200 and the lower casing member 115 of the ion pump 100. The relay casing member 117 is bonded to the upper casing member 213 of the heating and non-evaporating getter pump 200, thereby functioning as the casing 210 for the heating and non-evaporating getter pump 200. At the same time, the relay casing member 117 is bonded to the lower casing member 115 of the ion pump 100, thereby also functioning as the casing 110 for the ion pump 100. Incidentally, when the relay casing member 117 is bonded to the upper casing member 213 of the heating and non-evaporating getter pump 200 and the lower casing member 115 of the ion pump 100, flange portions formed in the respective casing members 213, 115 and 117 can be butted and bonded to each other. In this manner, it is possible to make the overall size of the ultra-high vacuum creating device 1 in the central-axis direction compact by providing the relay casing member 117 that can be shared between the heating and non-evaporating getter pump 200 and the ion pump 100.

In addition, the constricted portion 118 that is inwardly constricted is formed in the central portion of the relay casing member 117 in the central-axis direction. The plate-shaped magnets 141 and 142 of the ion pump 100 are arranged in the constricted portion 118 of the relay casing member 117.

In addition, FIG. 13 illustrates the ultra-high vacuum creating device 1 having a three-stage structure in which the heating and non-evaporating getter pumps 200 are stacked at the upper and lower stages, respectively, of the ion pump 100. When the ultra-high vacuum creating device 1 having the three-stage structure is constructed, the two relay casing members 117 may be provided.

In addition, FIG. 14 illustrates the ultra-high vacuum creating device 1 having a three-stage structure in which the one heating and non-evaporating getter pump 200 is further stacked above the ion pumps 100 stacked in two stages. In this case, the two relay casing member 117 may also be used.

[2-6. Multi-Stage Structure of Heating and Non-Evaporating Getter Pump]

Figure 15:
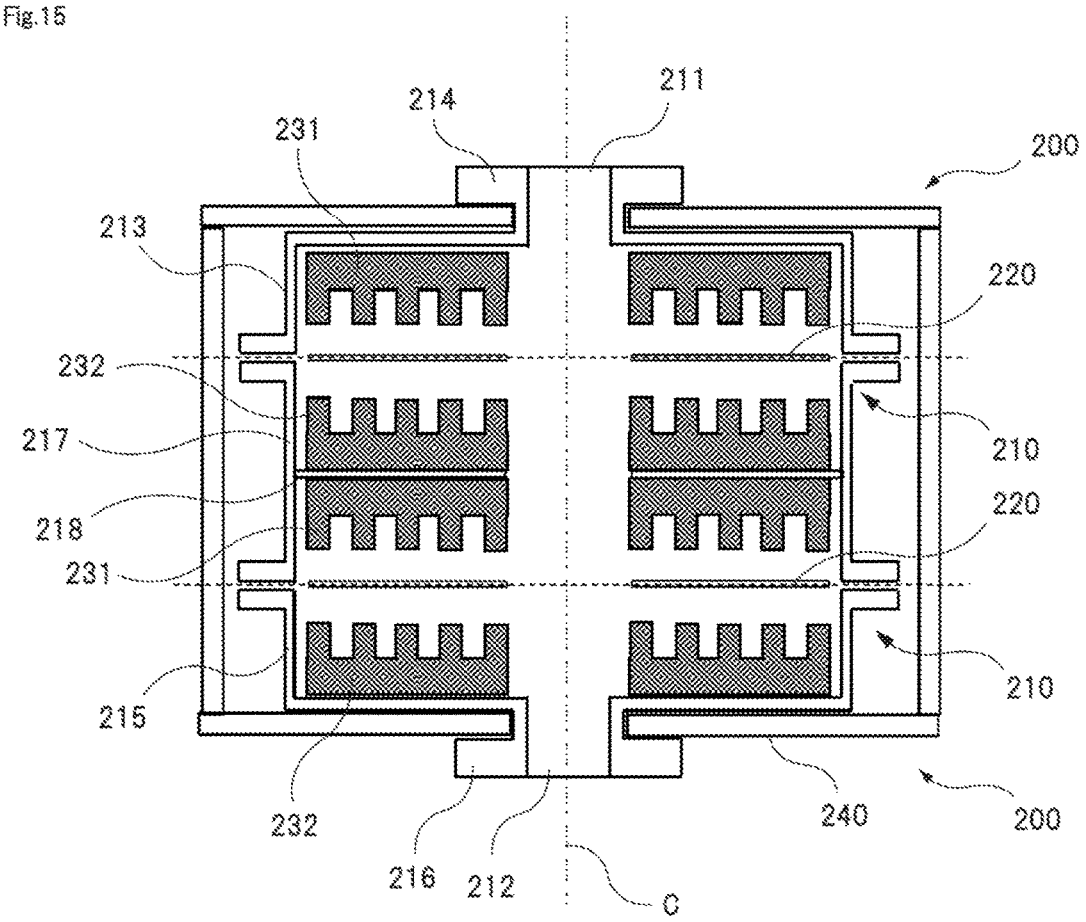
FIG. 15 is a cross-sectional view illustrating a configuration example of heating and non-evaporating getter pumps stacked in two stages.
Figure 16:
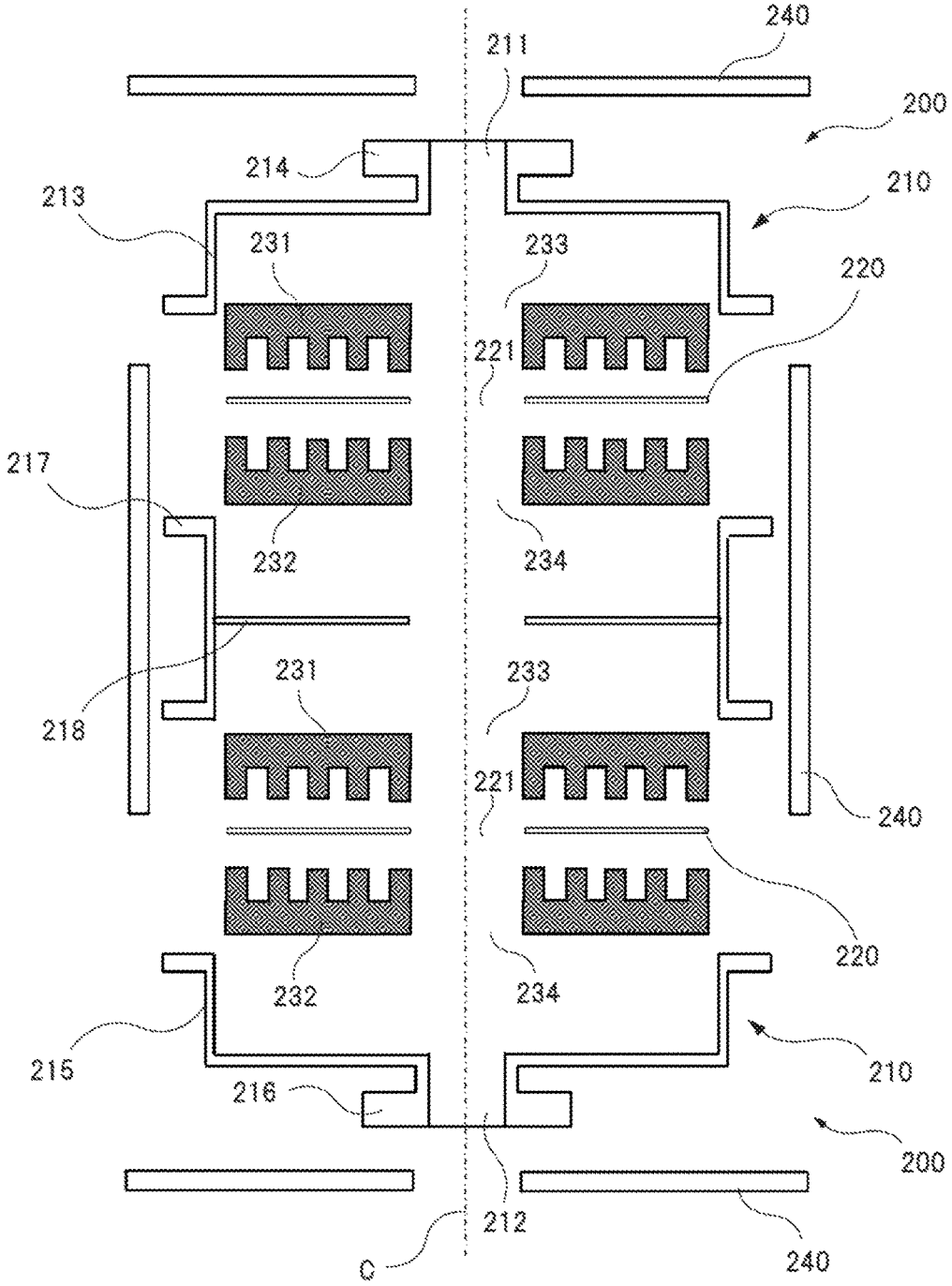
FIG. 16 is an exploded view illustrating the configuration example of the heating and non-evaporating getter pumps stacked in two stages.
Figure 17:
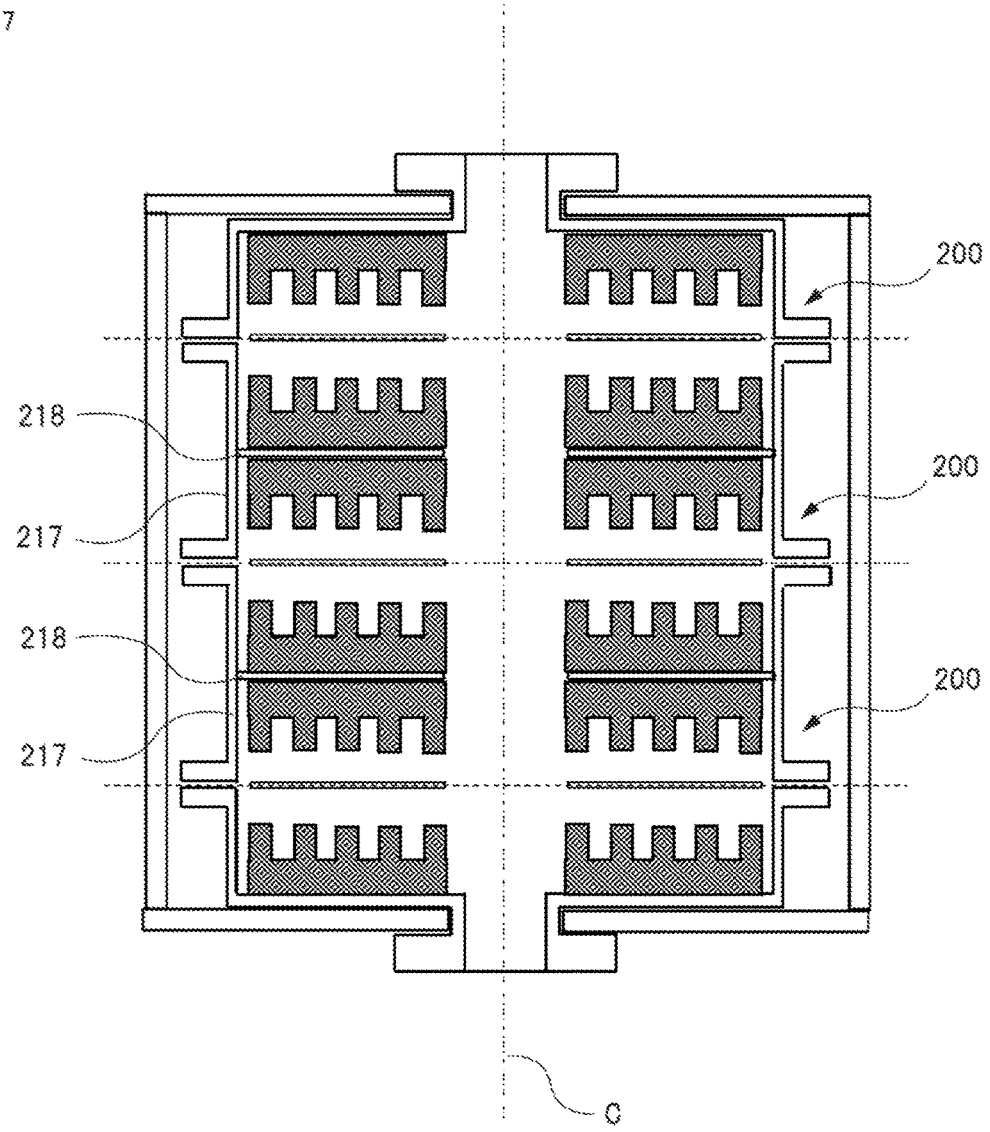
FIG. 17 is a cross-sectional view illustrating a configuration example of heating and non-evaporating getter pumps stacked in three stages.

FIGS. 15 to 17 illustrate multi-stage structures of the heating and non-evaporating getter pump 200 for reference. FIG. 15 illustrates an example of a structure in which the heating and non-evaporating getter pumps 200 are stacked in two stages. In addition, FIG. 16 illustrates an exploded view of the heating and non-evaporating getter pump 200 having the two-stage structure. As illustrated in FIGS. 15 and 16, the two heating and non-evaporating getter pumps 200 share the central axis (C), and a flow path is formed along the central axis (C). Thus, it is possible to efficiently supply gases to each of the two heating and non-evaporating getter pumps 200.

To be specific, when the heating and non-evaporating getter pumps 200 are stacked, the casing 210 includes a relay casing member 217 in addition to the upper casing member 213 in which the upper external connection flange 214 is formed and the lower casing member 215 in which the lower external connection flange 216 is formed. The relay casing member 217 is arranged between the upper casing member 213 and the lower casing member 215. The relay casing member 217 is bonded to the upper casing member 213, thereby functioning as the casing 210 for the heating and non-evaporating getter pump 200 at the upper stage. At the same time, the relay casing member 217 is bonded to the lower casing member 215, thereby also functioning as the casing 210 for the heating and non-evaporating getter pump 200 at the lower stage. Incidentally, when the relay casing member 217 is bonded to the upper casing member 213 and the lower casing member 215, flange portions formed in the respective casing members 213, 215 and 217 can be butted and bonded to each other. In this manner, it is possible to make the overall size of the ultra-high vacuum creating device 1 in the central-axis direction compact by providing the relay casing member 217 that can be shared between the upper-stage heating and non-evaporating getter pump 200 and the lower-stage heating and non-evaporating getter pump 200.

In addition, when the heating and non-evaporating getter pumps 200 are stacked as illustrated in FIGS. 16 and 17, a stay member 218 is preferably provided between the getter material 232 below the upper-stage heating and non-evaporating getter pump 200 and the getter material 231 above the lower-stage heating and non-evaporating getter pump 200. The stay member 218 is a support member to which the getter materials 231 and 232 are mounted. The stay member 218 can be formed in a disk shape, for example, which has an opening formed at the center thereof. The stay member 218 may be fixed to, for example, the relay casing member 217. When the stay member 218 is provided in this manner, it is possible to stably keep the getter materials 231 and 232.

FIG. 17 further illustrates the heating and non-evaporating getter pump 200 having a three-stage structure. As illustrated in FIG. 17, the two relay casing members 217 and the two stay members 218 may be provided when the heating and non-evaporating getter pump 200 are formed in the three-stage structure.

[3. Sublimation Pump]

Figure 18:
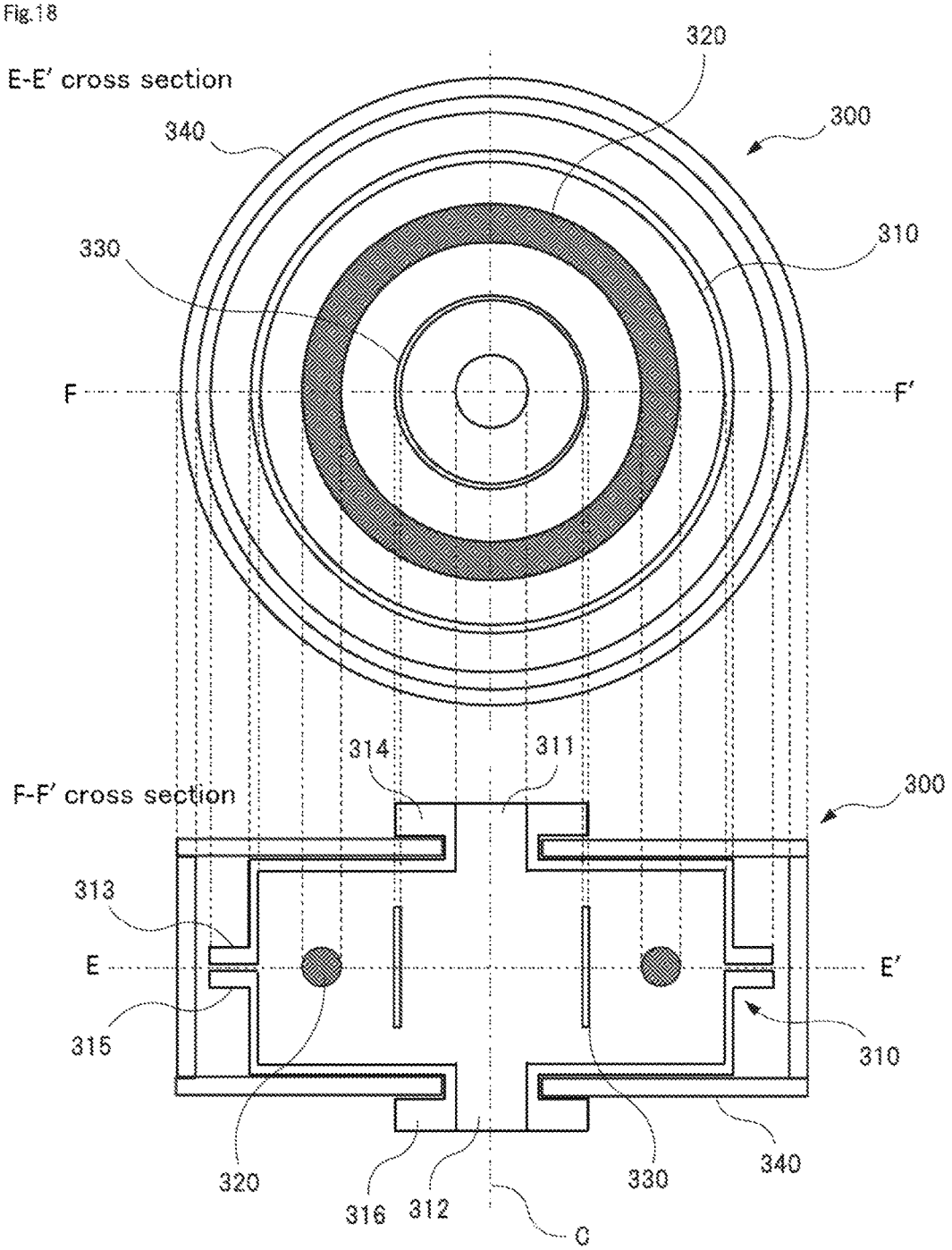
FIG. 18 is a cross-sectional view illustrating a configuration example of a sublimation pump.
Figure 19:
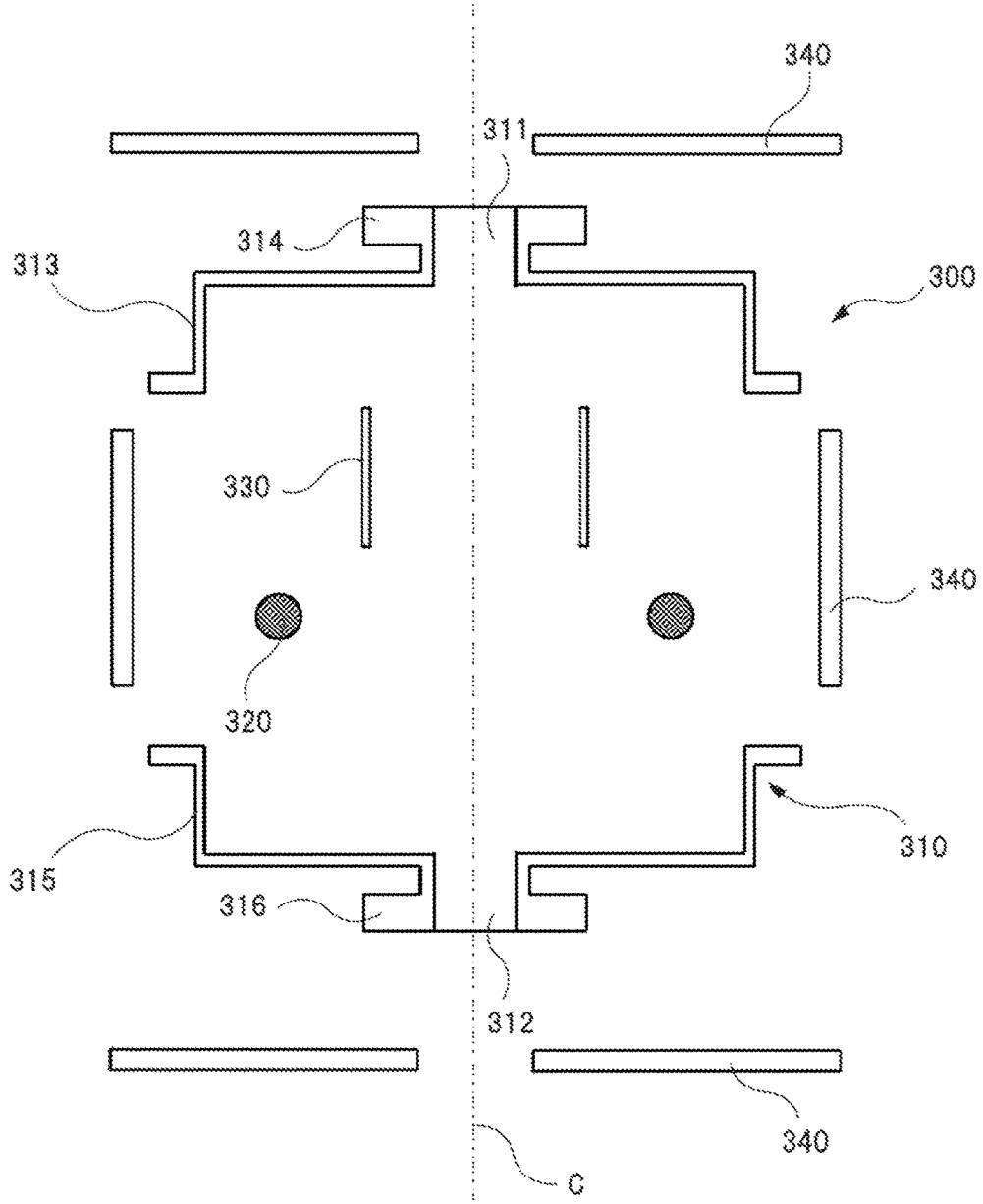
FIG. 19 is an exploded view illustrating the configuration example of the sublimation pump.
Figure 20:
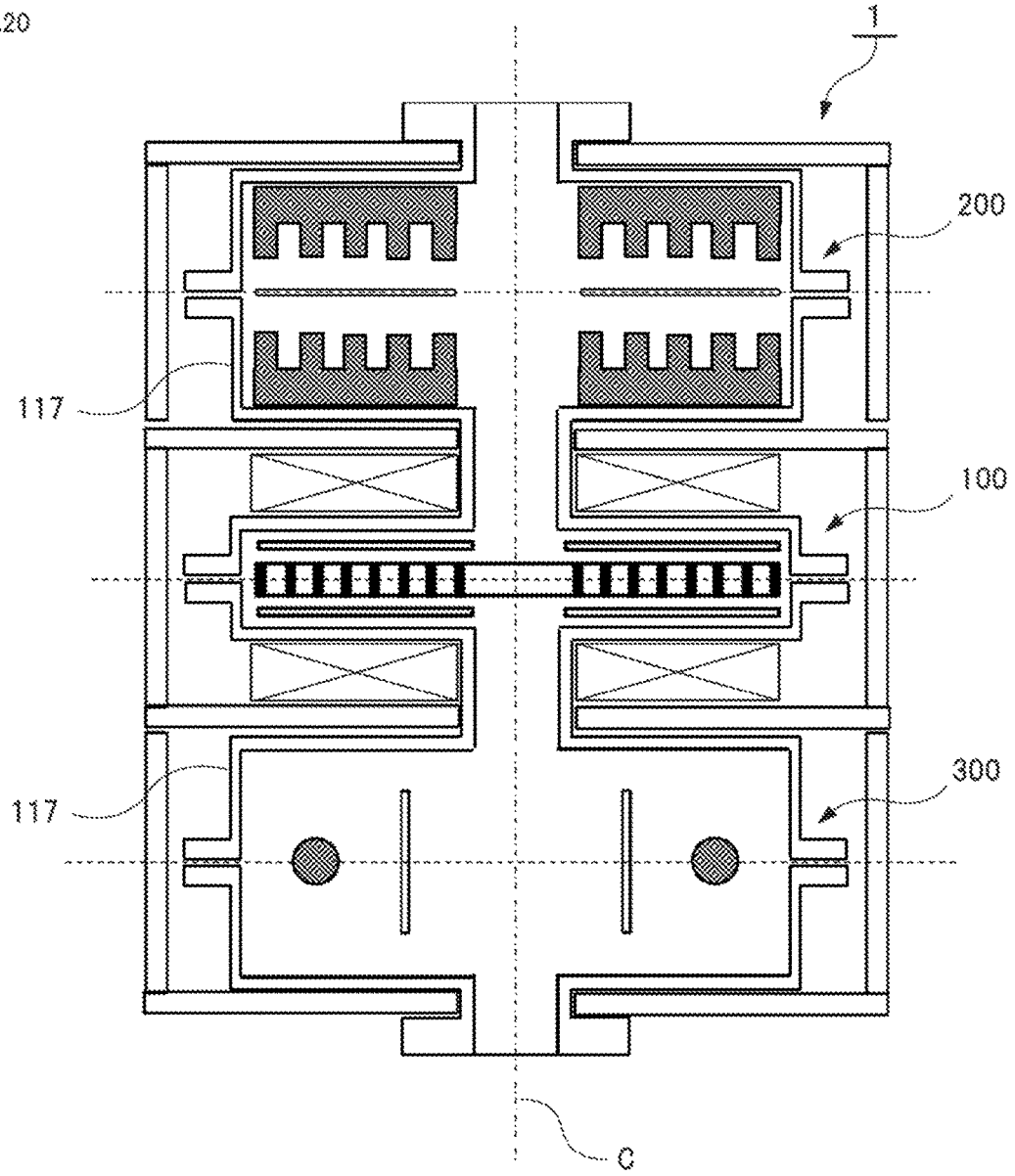
FIG. 20 is a cross-sectional view illustrating a state in which the ion pump, the heating and non-evaporating getter pump, and the sublimation pump are stacked.

The ultra-high vacuum creating device 1 according to the present invention may be provided with a sublimation pump 300 in addition to the ion pump 100. In addition, the above-described heating and non-evaporating getter pump 200 can be further combined. FIGS. 18 to 20 illustrate configuration examples of the sublimation pump 300. The sublimation pump 300 is a vacuum pump which performs exhaust by directly heating a sublimation filament inside a casing to be sublimated, and forming an active film to adsorb gases inside the casing. When the operation principle of the sublimation pump 300 is briefly described, first, a filament coated with titanium is electrically heated in vacuum so that the titanium on the filament surface is evaporated and vapor-deposited on each surface of the casing 310 and the shield 330. This series of phenomena is called sublimation. Further, a fresh face immediately after the vapor deposition of titanium has a strong molecular adsorption (getter) performance, and functions as a pump that adsorbs gases until the face is completely covered by gas molecules.

The ion pump 100 has an advantage that it is possible to collect an inert gas such as nitrogen, helium, and argon, but has a disadvantage that rough adsorption using another vacuum device in advance is required in order to use the ion pump 100 because an operating range thereof is the ultra-high vacuum (0.1 to $10^{-5}$ Pa) or lower. On the other hand, the sublimation pump 300 can operate in the low vacuum (100 Pa or higher) or the medium vacuum (100 to 0.1 Pa) and has an advantage that the operating range is relatively wide, but has a disadvantage that a vacuum level inside a vacuum bath temporarily deteriorates during the sublimation operation because the operating time of the formed active film is short and it is necessary to perform the sublimation work every two to four hours. Thus, it is possible to complement the disadvantages of the pumps one another by combining the ion pump 100 and the sublimation pump 300 like the ultra-high vacuum creating device 1 of the present invention. Therefore, it is possible to provide the ultra-high vacuum creating device 1 with the favorable usability by combining the ion pump 100 and the sublimation pump 300. It is novel to provide such a uniaxially symmetric structure of the sublimation pump 300 in order for series-connection with another pump.

FIG. 18 illustrates the configuration example of the sublimation pump 300. FIG. 18 illustrates a cross-sectional view when the sublimation pump is seen in a plan view, and a cross-sectional view when the sublimation pump is seen from a side view. In addition, FIG. 19 illustrates an exploded view of the sublimation pump 300. As illustrated in FIGS. 18 and 19, the sublimation pump 300 is configured to include a casing 310, a sublimation filament 320, a shield member 330, and a heat shield 340. In the present embodiment, the casing 310 is arranged inside the heat shield 340. In addition, the sublimation filament 320 and the shield member 330 are arranged inside the casing 310. In addition, external connection flanges 314 and 316 formed in the casing 310 protrude outside the heat shield 340. The sublimation pump 300 is connected to another external device via the external connection flanges 314 and 316. The external device to which the sublimation pump 300 is connected is, for example, a vacuum chamber, a sample chamber, or the like which is a target to be turned into a vacuum state. In addition, the external device may be another vacuum pump (an ion pump, a heating and non-evaporating getter pump, a sublimation pump, and the like).

[3-1. Casing]

The casing 310 is a frame which forms a workspace configured to collect gas molecules or to house a sample and experimental equipment or causing the sample and the experimental equipment to pass therethrough. The casing 310 of the sublimation pump 300 has basically the same structure as the casing 110 of the ion pump 100 described above. Thus, the description for the casing 110 of the ion pump 100 can be appropriately incorporated to the description for the casing 310 of the sublimation pump 300.

That is, the casing 310 of the sublimation pump 300 includes at least one opening (311 or 312). In the embodiment illustrated in FIG. 18, the casing 310 includes the two openings 311 and 312. Accordingly, the sublimation pump 300 is extensible in multiple stages in the up-and-down direction. In addition, a space, configured to house the sublimation filament 320 and the shield member 330, is formed in the sublimation pump 300 by bonding the upper casing member 313 and the lower casing member 315. In addition, the upper casing member 313 includes the upper external connection flange 314, the lower casing member 315 includes the lower external connection flange 316. The upper opening 311 is formed in the upper external connection flange 314, and the lower opening 312 is formed in the lower external connection flange 316. Further, both the upper opening 311 and the lower opening 312 are formed on the central axis (C) in the casing 310. Accordingly, a flow path passing from the flow path passing the upper opening 311 through the lower opening 312 is linearly formed in the casing 310.

[3-2. Sublimation Filament]

The sublimation filament 320 is a member that is sublimated when being heated by electrical heating to form the active film having the getter effect inside the casing 310. Thus, the sublimation filament 320 is connected to a power supply (not illustrated). A known material having the getter effect can be used as the sublimation filament 320. For example, the sublimation filament 320 may be a simple metal substance made of titanium, samarium, titanium, ytterbium, gadolinium, or erbium or may be made of an alloy including these metals.

As illustrated in FIG. 18, the sublimation filament 320 is formed in a ring shape having an opening at the center thereof. In particular, the sublimation filament 320 has preferably a circular ring shape. However, the sublimation filament 320 may have a triangular ring shape, a square ring shape, or other polygonal ring shapes.

The sublimation filament 320 and the casing 310 share the central axis (C). Thus, the opening of the sublimation filament 320 communicates with the two openings 311 and 312 of the casing 310 along the central axis (C).

[3-3. Shield Member]

The shield member 330 is a member configured to form the active film by causing metal atoms generated from the sublimation filament 320 and having the getter effect to adhere thereto. When the shield member 330 is provided, a surface area of the active film is improved. As illustrated in FIG. 18, the shield member 330 is arranged at the inner side of the ring-shaped sublimation filament 320 inside the casing 310. The shield member 330 also provides a function of preventing a member released from the filament from intruding into the workspace around the central axis.

The shield member 330 has preferably a ring shape as illustrated in FIG. 18. In particular, the shield member 330 has preferably a circular ring shape. However, the shield member 330 may have a triangular ring shape, a square ring shape or other polygonal ring shapes. The shape of the shield member 330 may be formed in accordance with the shape of the sublimation filament 320. In this manner, the shield member 330 is arranged inside the opening formed at the center of the sublimation filament 320.

The shield member 330 and the casing 310 and the sublimation filament 320 share the central axis (C). Thus, the opening of the shield member 330 communicates with the two openings 311 and 312 of the casing 310 and the opening of the sublimation filament 320 along the central axis (C). Accordingly, a linear flow path is formed in the sublimation pump 300 along the central axis (C).

[3-4. Heat Shield]

The heat shield 340 is a shield member which is configured to house the casing 310 therein and to prevent heat generated by the sublimation filament 320 from leaking to the outside. The heat shield 3400 is a member that is arbitrarily provided, but is preferably provided in order to prevent an external device from being affected by the heat. The heat shield 340 can be formed using a known material. In addition, an opening is formed in a part of the heat shield 340 so that the external connection flanges 314 and 316 of the casing 310 protrude through the opening as illustrated in FIG. 18.

[2-5. Combination of Ion Pump, Sublimation Pump and Heating and Non-Evaporating Getter Pump]

The sublimation pump 300 having the above-described configuration can be combined with the ion pump 100 and the heating and non-evaporating getter pump 200 in a stacked manner. That is, the ultra-high vacuum creating device 1 of the present invention can be constructed by combining one or a plurality of ion pumps 100 with one or a plurality of heating and non-evaporating getter pumps 200 and one or a plurality of sublimation pumps 300. FIG. 20 illustrates an example of combination of the ion pump 100, the heating and non-evaporating getter pump 200, and the sublimation pump 300.

FIG. 20 illustrates a configuration example in which the one ion pump 100, the one heating and non-evaporating getter pump 200, and the one sublimation pump 300 are combined. As illustrated in FIG. 12, the ion pump 100, the heating and non-evaporating getter pump 200, and the sublimation pump 300 share the central axis (C), and a flow path is formed along the central axis (C). Thus, it is possible to efficiently supply gases to each of the ion pump 100, the heating and non-evaporating getter pump 200, and the sublimation pump 300.

To be specific, the two relay casing members 117 are provided when the heating and non-evaporating getter pump 200 and the sublimation pump 300 are stacked on the ion pump 100. In such a three-stage structure, the casing 110 of the ion pump 100 positioned at the middle stage is formed by bonding the two relay casing members 117 to each other. In addition, the upper relay casing member 117 is bonded to the lower casing member 215 of the heating and non-evaporating getter pump 200. Thus, the upper relay casing member 117 functions as both the casing 110 of the ion pump 100 and the casing 210 of the heating and non-evaporating getter pump 200. In addition, the lower relay casing member 117 is bonded to the upper casing member 313 of the sublimation pump 300. Thus, the lower relay casing member 117 functions as both the casing 110 of the ion pump 100 and the casing 310 of the sublimation pump 300. In this manner, it is possible to make the overall size of the ultra-high vacuum creating device 1 in the central-axis direction compact by providing the relay casing member 117 that can be shared among the respective vacuum pumps 100, 200 and 300.

In addition, the constricted portion 118 that is inwardly constricted is formed in the central portion of the relay casing member 117 in the central-axis direction. The plate-shaped magnets 141 and 142 of the ion pump 100 are arranged in the constricted portion 118 of the relay casing member 117.

The embodiment of the present invention has been described as above with reference to drawings in the specifications of the present application in order to express the content of the present invention. However, the present invention is not limited to the embodiment described hereinbefore, and encompasses obvious modifications and improvements made by those skilled in the art based on the matters described in the specifications of the present application.

FIGS. 1 to 20 illustrates the examples of how to combine the ion pump 100, the heating and non-evaporating getter pump 200, and the sublimation pump 300. However, the method of combining these pumps 100, 200 and 300 is not limited to the drawings, and the combination can be made by freely selecting each number or arrangement of the pumps as necessary.

INDUSTRIAL APPLICABILITY

The present invention relates to the ultra-high vacuum creating device including the ion pump. The ultra-high vacuum creating device of the present invention can be suitably applied to, for example, an ion beam processing device, various processing devices, an ionized gas generation device, an ion source generation device, and the like. In addition, the ultra-high vacuum creating device of the present invention can also be suitably applied to, for example, a synchrotron radiation facility, an ion trap, an atomic clock, and the like.

REFERENCE SIGNS LIST

1 ultra-high vacuum creating device
2 power supply
3 earth
100 ion pump
110 casing
111 upper opening
112 lower opening
13 upper casing member
114 external connection flange (upper side)
115 lower casing member
116 external connection flange (lower side)
117 relay casing member
118 constricted portion
120 electrode group
120*a* center opening
121 electrode
122 conducting wire
123 hollow electrode
123*a* upper and lower flat surface portions
123*b* side surface portion
124 center opening
131 plate-shaped electrode (upper side)
132 plate-shaped electrode (lower side)
133 center opening (upper side)
134 center opening (upper side)
141 plate-shaped magnet (upper side)
142 plate-shaped magnet (lower side)
143 center opening (upper side)
144 center opening (lower side)
145 shared plate-shaped magnet
150 magnetic shield
200 heating and non-evaporating getter pump
210 casing
211 upper opening
212 lower opening
213 upper casing member
214 external connection flange (upper side)
215 lower casing member
216 external connection flange (lower side)
217 relay casing member
218 stay member
220 heater
221 center opening
231 getter material (upper side)
232 getter material (lower side)
233 center opening (upper side)
234 center opening (lower side)
235 concave portion
236 convex portion
240 heat shield
300 sublimation pump
310 casing
311 upper opening
312 lower opening
313 upper casing member
314 external connection flange (upper side)
315 lower casing member
316 external connection flange (lower side)
320 sublimation filament
330 shield member
340 heat shield

The invention claimed is:

1. An ultra-high vacuum creating device, comprising:

at least one ion pump (100), wherein the ion pump (100) includes:

a casing (110) which has at least one opening (111, 112);

a plate-shaped electrode group (120) which is arranged inside the casing (110) and has a structure in which a center opening (120*a*) is formed along a predetermined central axis (C), wherein the plate-shaped electrode group 120 is configured to include spiral-shaped or honeycomb-shaped (hexagonal lattice shaped) electrodes (121) connected at intervals;

a pair of plate-shaped electrodes (131, 132) which is arranged at positions inside the casing (110) such that the electrode group (120) is sandwiched between the pair of plate-shaped electrodes (131, 132); and a pair of plate-shaped magnets (141, 142) which is arranged at positions such that the pair of plate-shaped electrodes (131, 132) is sandwiched between the pair of plate-shaped magnets (141, 142) from both sides and applies a magnetic field inside the casing (110);

at least one heating and non-evaporating getter pump (200), wherein the heating and non-evaporating getter pump (200) includes a second casing (210) which has at least one second opening (211, 212);

a heater (220) which is arranged inside the second casing (210); and a pair getter materials (231, 232) which is arranged at positions inside the second casing (210) such that the heater (220) is sandwiched between the pair of getter materials (231,232) and is activated when being heated by radiant heat from the heater (220), and the at least one second opening (211, 212) of the heating and non-evaporating getter pump (200) communicates with the at least one second opening (111, 112) the ion pump (100);

a relay casing member (117) being arranged between upper casing member (213) of the heating and non-evaporating getter pump (200) and lower casing member (115) of the ion pump (100), and a magnetic shield (150) housing the casing 110 and the plate-shaped magnets 141 and 142 therein and preventing magnetism of the plate-shaped electrodes (131, 132) from leaking outside the casing (110).

2. The ultra-high vacuum creating device according to claim 1, wherein the casing (110) of the ion pump (100) includes the at least one opening (111, 112) formed on the central axis (C), the pair of plate-shaped electrodes (131, 132) includes first center openings (133, 134), respectively, formed on the central axis (C), the pair of plate-shaped magnets (141, 142) includes second center openings (143, 144), respectively, formed on the central axis (C), and a flow path is formed along the central axis (C) through the at least one opening, the first center openings and the second center openings.

3. The ultra-high vacuum creating device according to claim 2, wherein when the ultra-high vacuum creating device comprises two or more ion pumps (100), the two or more ion pumps (100) are stacked in two or more stages along the central-axis (C) direction, and two neighboring ion pumps of the two or more ion pumps (100) share one of the pair of plate-shaped magnets (141, 142).

4. The ultra-high vacuum creating device according to claim 1, wherein the second casing (210) of the heating and non-evaporating getter pump (200) includes at least one second opening (211, 212) formed on the central axis (C), the heater (220) includes a third center opening (221) formed on the central axis (C), the pair of getter materials (231, 232) includes fourth center openings (233, 234), respectively, formed on the central axis (C), and a flow path is formed along the central axis (C) through the at least one second opening, the third center opening and the fourth center openings.

5. The ultra-high vacuum creating device according to claim 1, wherein the ultra-high vacuum creating device further comprises at least one sublimation pump (300), the sublimation pump (300) includes:

a casing (310) which has at least one opening (311, 312); and a ring-shaped sublimation filament (320) which is arranged inside the casing (310) and sublimated when current flows, and the at least one opening (311, 312) of the sublimation pump (300) communicates with the at least one opening (111, 112) of the ion pump (100).

* * * * *